United States Patent [19]

Kling et al.

[11] 4,399,407

[45] Aug. 16, 1983

[54] ENGINE ANALYZER WITH CONSTANT WIDTH DIGITAL WAVEFORM DISPLAY

[75] Inventors: Michael J. Kling, Mequon; Joseph A. Marino, Waukesha, both of Wis.

[73] Assignee: Bear Automotive Service Equipment Company, Milwaukee, Wis.

[21] Appl. No.: 327,511

[22] Filed: Dec. 4, 1981

[51] Int. Cl.[3] ..... F02P 17/00

[52] U.S. Cl. ..... 324/379; 73/117.3; 324/384

[58] Field of Search ..... 324/379, 378, 384; 73/117.3, 117.2, 116; 364/551, 431.03, 442

[56] References Cited

U.S. PATENT DOCUMENTS

| | | | |
|---|---|---|---|
| 4,254,744 | 3/1981 | Mizote | 73/117.3 X |
| 4,277,830 | 7/1981 | Reid et al. | 364/551 X |
| 4,301,678 | 11/1981 | Full et al. | 73/116 |

*Primary Examiner*—Stanley T. Krawczewicz

*Attorney, Agent, or Firm*—Kinney, Lange, Braddock, Westman and Fairbairn

[57] ABSTRACT

An engine analyzer for an internal combustion engine includes an analog-to-digital (A/D) converter which digitizes an analog electrical input waveform representing, for example, a secondary or primary voltage waveform of the ignition coil of the internal combustion engine. The digitized input waveform is stored in the form of digital data in a data mamory. Upon request by the operator of the apparatus, a microprocessor selects digital data stored, and supplies that digital data to a display, which displays a visual representation of the waveform based upon the selected digital data. The engine analyzer apparatus produces a constant width waveform regardless of engine RPM, by determining the period of the waveform to be stored, and then varying the sample rate at which the A/D converter samples the analog waveform and converts the sampled waveform to digital data. As a result, the number of data samples, and thus the width of the displayed waveform, is constant.

21 Claims, 6 Drawing Figures

ENGINE ANALYZER WITH CONSTANT WIDTH DIGITAL WAVEFORM DISPLAY

CROSS-REFERENCE TO RELATED APPLICATIONS

Reference is hereby made to the following copending applications, which were filed on even date with the present application and are assigned to the same assignee as the present application: ENGINE ANALYZER WITH DIGITAL WAVEFORM DISPLAY, J. Marino, M. Kling, and S. Roth, Ser. No. 327,734, filed Dec. 4, 1981; ENGINE ANALYZER WITH SIMULATED ANALOG METER DISPLAY, M. Kling and J. Marino, Ser. No. 327,732, filed Dec. 4, 1981; and IGNITION COIL TEST APPARATUS, J. Marino, M. Kling, S. Roth and S. Makhija, Ser. No. 327,733, filed Dec. 4, 1981.

BACKGROUND OF THE INVENTION

1. Field of the Invention

The present invention relates to engine analzyer apparatus used for testing internal combustion engines.

2. Description of the Prior Art

One common type of engine analyzer apparatus used for testing an internal combustion engine employs a cathode ray tube having a display screen on which analog waveforms are displayed which are associated with operation of the engine. In a typical apparatus of this type, a substantially horizontal trace is produced on the screen of the cathode ray tube by applying a sawtooth ramp voltage between the horizontal deflection plates of the tube while the analog signal being measured is applied to the vertical deflection plates of the tube. The typical analog signals which are applied to the vertical plates of the cathode ray tube are the primary voltage which exists across the primary winding of the ignition coil, and a signal representative of the secondary voltage of the ignition coil. These voltages are affected by the condition of various elements of the ignition system of the engine, such as the spark plugs.

In the case of a multicylinder internal combustion engine, the primary and secondary voltage waveforms have typically been displayed on the cathode ray tube in one of two ways. In one case, the waveform being displayed represents a complete cycle of the engine, in which the conditions associated with the various cylinders are displayed sequentially in a predetermined pattern. This type of display has commonly been referred to as a "parade" pattern or display.

In the other common method of displaying waveforms, there are a plurality of horizontal traces, one above the other, with each trace being associated with the operation of one of the cylinders of the engine. The number of horizontal traces usually corresponds to the number of cylinders on the engine. This method of displaying waveforms has been referred to in the industry as a "raster" display.

With the advent of low cost microelectronic devices, and in particular microprocessors, digital electronic systems have found increasing use in a wide variety of applications. Digital electronic systems have many significant advantages over analog systems, including increased ability to analyze and store data, higher accuracy, greater flexibility in design and application, and the ability to interface with computers having larger and more sophisticated data processing and storage capabilities. In the past, some engine analyzer systems have been proposed which utilize microprocessors and digital circuitry to control some of the functions of the engine analyzer apparatus. In these prior art systems, however, the waveform display function of the engine analyzer apparatus has remained essentially an analog electrical function, even when the systems utilize microprocessors and digital electronics for other functions.

SUMMARY OF THE INVENTION

The present invention is an engine analyzer apparatus for an internal combustion engine in which waveforms representing operation of a system or component of an internal combustion engine are displayed. Analog electrical input waveforms are digitized by the system of the present invention, and the digitized input waveform is stored in the form of digital data. Digital control means, which preferably includes a programmed digital computer such as a microprocessor, selects digital data which has been stored. Display means displays a simulated visual representation of an analog waveform based upon the selected digital data.

In the system of the present invention, constant width waveforms are displayed, despite variations in engine rpm. In the present invention, analog-to-digital (A/D) converter means digitizes the input analog waveform by sampling the input waveform at a data sample rate and converting each of the samples to a digital value. To achieve a full width displayed waveform, the engine analyzer system of the present invention varies the data sample rate of the A/D converter means so that the number of data samples remains constant despite variations in the period of the input analog waveform to be converted and stored. Thus each simulated waveform displayed by the display means is formed based upon a constant number of data samples.

In preferred embodiments of the present invention, the engine analyzer apparatus of the present invention includes a digital computer means, a waveform storage memory means for storing the digitized waveform, the analog-to-digital (A/D) converter means, a clock prescaler means, a period measuring counter means, and a sample clock generator means. In addition, transfer of digital data from the A/D converter means to the waveform storage memory means is preferably performed by a direct memory address (DMA) controller means in conjunction with a data buffer means which receives the digital data from the A/D converter means.

In this preferred embodiment of the invention, a high frequency clock signal is supplied to the clock prescaler means, which in turn provides a scaled clock signal based upon a digital scaling value supplied to the clock prescaler means by the digital computer means. The scaled clock signal is supplied to both the period measuring counter means and the sample clock generator means. The period measuring counter means measures the period of the waveform to be digitized and supplies a digital value to the digital computer means indicative of the measured period of the waveform. Based upon this digital value, the digital computer means provides a digital signal to the sample clock generator means. The output of the sample clock generator means is a sample clock signal which is supplied to the A/D converter means. The frequency of the sample clock signal, and thus the data sample rate used by the A/D converter means, is a function of the frequency of the scaled clock signal and the digital signal supplied to the sample clock generator means by the digital computer means. Each time the A/D converter means samples the input waveform, it supplies digital data to the buffer means. The DMA controller means transfers the data from the buffer means to selected memory locations in the waveform storage memory means.

DETAILED DESCRIPTION OF THE PREFERRED EMBODIMENTS

Figure 1:
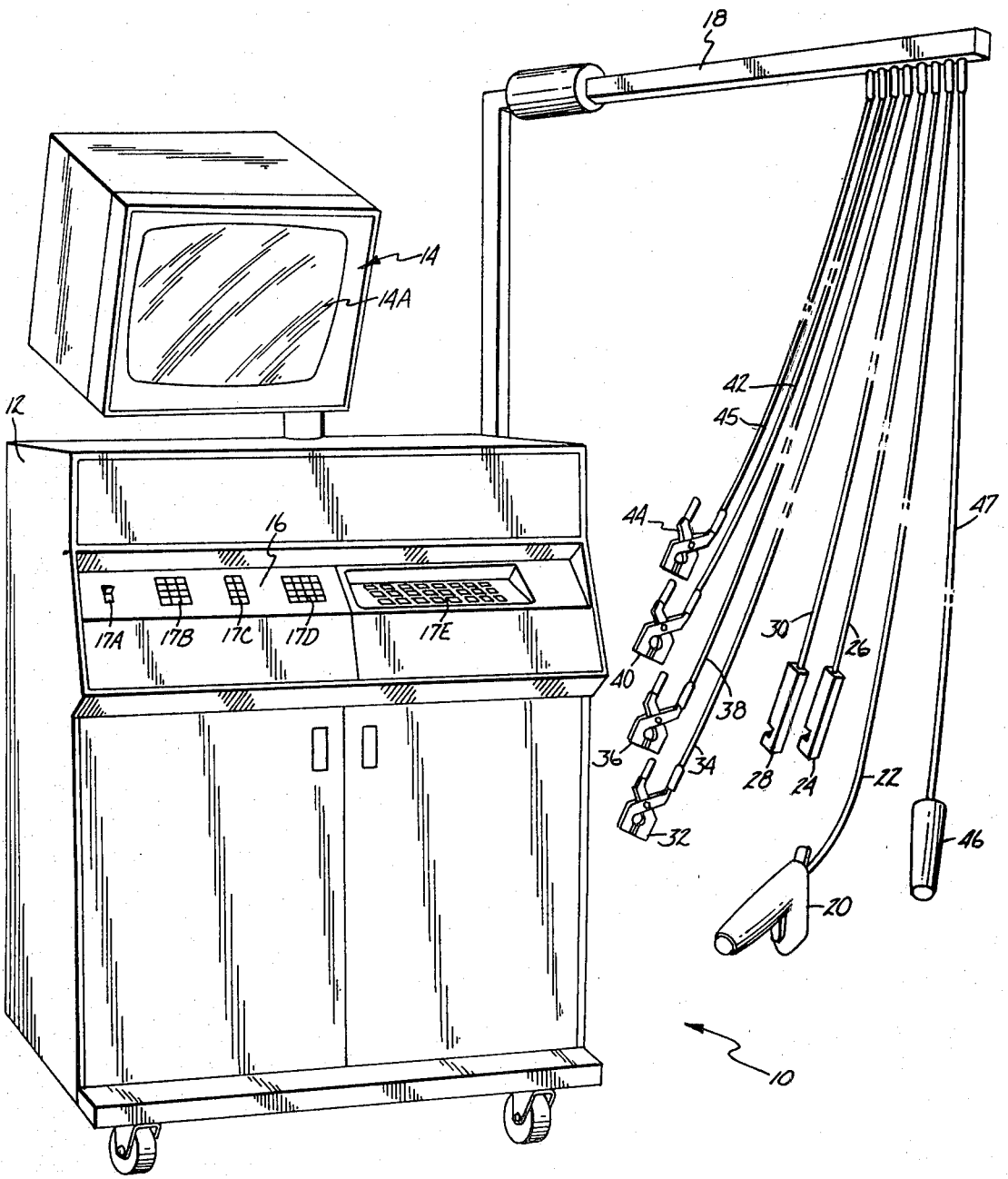
FIG. 1 is a perspective view showing an engine analyzer apparatus which utilizes the present invention.

In FIG. 1, engine analyzer 10 is shown. Mounted at the front of housing 12 of analyzer 10 are cathode ray tube (CRT) raster scan display 14 and user interface 16, which is preferably a control panel having a power switch 17A, three groups of control switches or keys 17B–17D, as well as a keyboard 17E for entering numerical information. Extending from boom 18 are a plurality of cables which are electrically connected to the circuitry within housing 12, and which are intended for use during operation of the analyzer 10. Timing light 20 is connected at the end of multiconductor cable 22. "High tension" (HT) probe 24 is connected at the end of multiconductor cable 26, and is used for sensing secondary voltage of the ignition system of an internal combustion engine of a vehicle (not shown). "No. 1" probe 28 is connected to the end of multiconductor cable 30, and is used to sense the electrical signal being supplied to the No. 1 sparkplug of the ignition system. "Engine Ground" connector 32, which is preferably an alligator-type clamp, is connected at the end of cable 34, and is typically connected to the ground terminal of the battery of the ignition system. "Points" connector 36, which is preferably an alligator-type clamp, is attached to the end of cable 38 and is intended to be connected to one of the primary winding terminals of an ignition coil of the ignition system. "Coil" connector 40, which is preferably an alligator-type clamp attached to the end of cable 42, is intended to be connected to the other primary winding terminal of the ignition coil. "Battery" connector 44, which is preferably an alligator-type clamp, is attached to the end of cable 45. Battery connector 44 is connected to the "hot" or "non-ground" terminal of the battery of the ignition system. Vacuum transducer 46 at the end of multiconductor cable 47 produces an electrical signal which is a linear function of vacuum or pressure, such as input manifold vacuum or pressure.

In the present invention, electrical signals derived from probes 24 and 28 from connectors 32, 36, 40 and 44 and from vacuum transducer 46 are used to produce digitized waveforms which are stored as digital data in digital memory. Upon request by the user through user interface 16, analyzer 10 of the present invention displays on display 14 waveforms derived from selected stored digital data. In the present invention, therefore, the waveforms displayed by raster scan display 14 are not real time analog waveforms, as in the prior art engine analyzers, but rather are simulated representations of individual digitized waveforms which have previously been stored.

Figure 2:
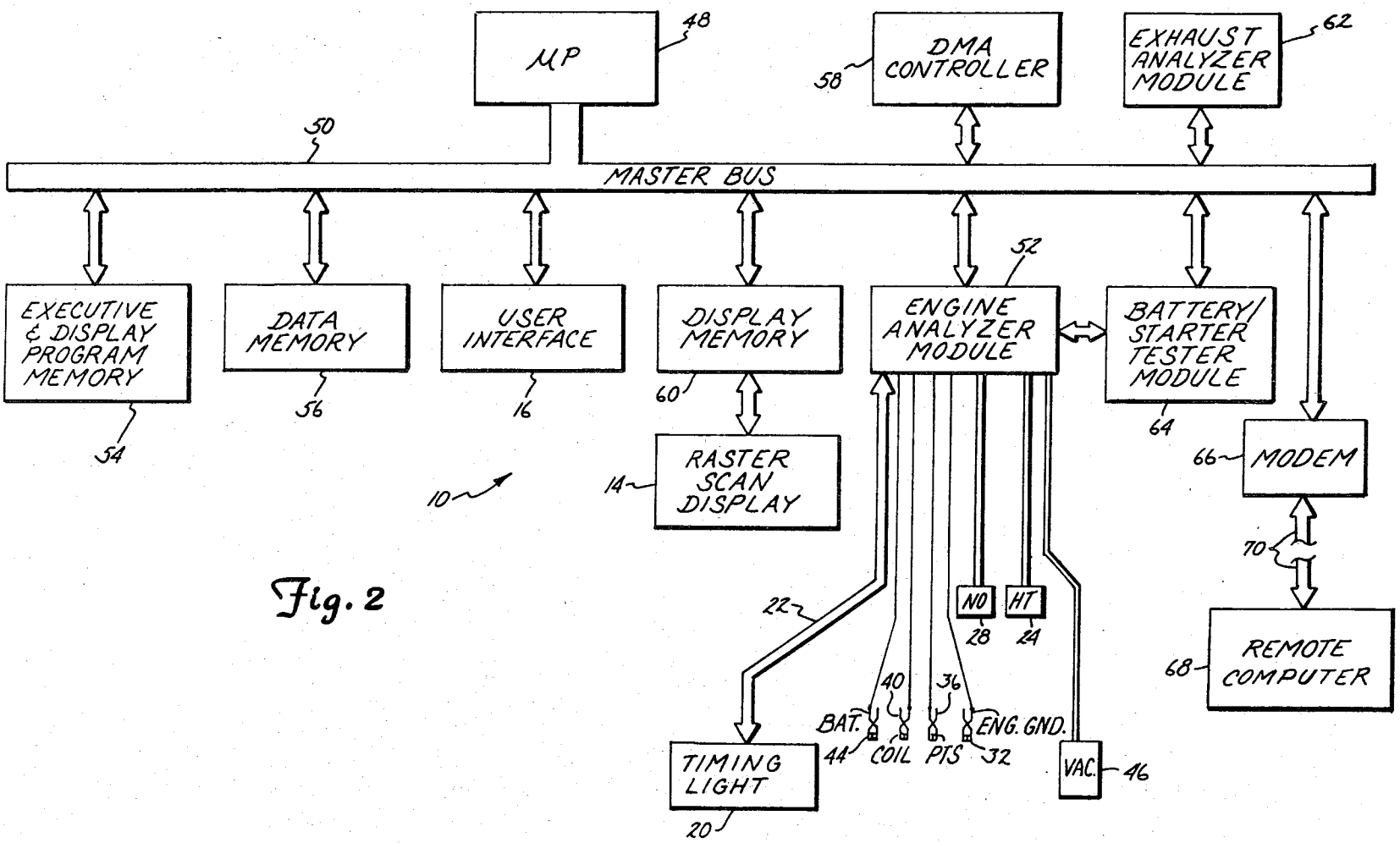
FIG. 2 is an electrical block diagram of the engine analyzer apparatus of FIG. 1.

FIG. 2 is an electrical block diagram showing engine analyzer 10 of the present invention. Operation of engine analyzer 10 is controlled by microprocessor 48, which communicates with the various subsystems of engine analyzer 10 by means of master bus 58. In the preferred embodiments of the present invention, master bus 50 is made up of fifty-six lines, which form a data bus, an address bus, a control bus, and a power bus.

Timing light 20, HT probe 24, No. 1 probe 28, Engine Ground connector 32, Points connector 36, Coil connector 40, Battery connector 44, and vacuum transducer 46 interface with the electrical system of engine analyzer 10 through engine analyzer module 52. As described in further detail later, engine analyzer module 52 includes a digital section and an analog section. Input signal processing is performed in the analog section, and the input analog waveforms received are converted to digitized waveforms in the form of digital data. The digital section of engine analyzer module 52 interfaces with master bus 50.

Control of the engine analyzer system 10 by microprocessor 48 is based upon a stored program in engine analyzer module 52 and a stored program in executive and display program memory 54 (which interfaces with master bus 50). Digitized waveforms produced, for example, by engine analyzer module 52 are stored in data memory 56. The transfer of digitized waveforms from engine analyzer module 52 to data memory 56 is provided by direct memory access (DMA) controller 58. When engine analyzer module 52 provides a DMA Request signal on master bus 50, DMA controller 58 takes control of master bus 50 and transfers the digitized waveform data from engine analyzer module 52 directly to data memory 56. As soon as the data has been transferred, DMA controller 58 permits microprocessor 48 to again take control of master bus 50. As a result, the system of the present invention, as shown in FIG. 2, achieves storage of digitized waveforms in data memory 56 without requiring an inordinate amount of time of microprocessor 48 to accomplish the data transfer.

User interface 16 interfaces with master bus 50 and permits the operator to enter data and select particular tests or particular waveforms to be displayed. When the operator selects a particular waveform by means of user interface 16, microprocessor 48 retrieves the stored digitized waveform from data memory 56, converts the digitized waveform into the necessary digital display data to reproduce the waveform on raster scan display 14, and transfers that digital display data to display memory 60. As long as the digital display data is retained by display memory 60, raster scan display 14 continues to display the same waveform.

Display memory 60 contains one bit for each picture element (pixel) that can be displayed on raster scan display 14. Each bit corresponds to a dot on the screen of raster scan display 14. In preferred embodiments of the present invention, the digitized waveform stored in data memory 56 represents individual sampled points on the waveform. Executive and display program memory 54 includes a stored display program which permits microprocessor 48 to "connect the dots" represented by the individual sampled points of the digitized waveform, so that the waveform displayed by raster scan display 14 is a reconstructed simulated waveform which has the appearance of a continuous analog waveform, rather than simply a series of individual dots. Microprocessor 48 determines the coordinates of the dot representing one digitized sampled point on the digitized waveform, determines the coordinates of the next dot, and then fills in the space between the two dots with additional intermediate dots to give the appearance of a continuous waveform. The digital display data stored in display memory 60, therefore, includes bits corresponding to the individual sampled points on the waveform which had been stored by data memory 56, plus bits corresponding to the intermediate dots between these individual sampled points.

As further illustrated in FIG. 2, engine analyzer 10 has the capability of expansion to perform other engine test functions by adding other test modules. These modules can include, for example, exhaust analyzer module 62 and battery/starter tester module 64. Both modules 62 and 64 interface with the remaining system of analyzer 10 through master bus 50 and provide digital data or digitized waveforms based upon the particular tests performed by those modules. In the preferred embodiments shown in FIG. 2, modulator/demodulator (MODEM) 66 also interfaces with master bus 50, to permit analyzer 10 to interface with remote computer 68 through communication link 70. This is a particularly advantageous feature, since remote computer 68 typically has greater data storage and computational capabilities that are present within analyzer 10. Modem 66 permits digitized waveforms stored in data memory 56 to be transferred to remote computer 68 for further analysis, and also provides remote computer 68 to provide test parameters and other control information to microprocessor 48 for use in testing.

Figure 3:
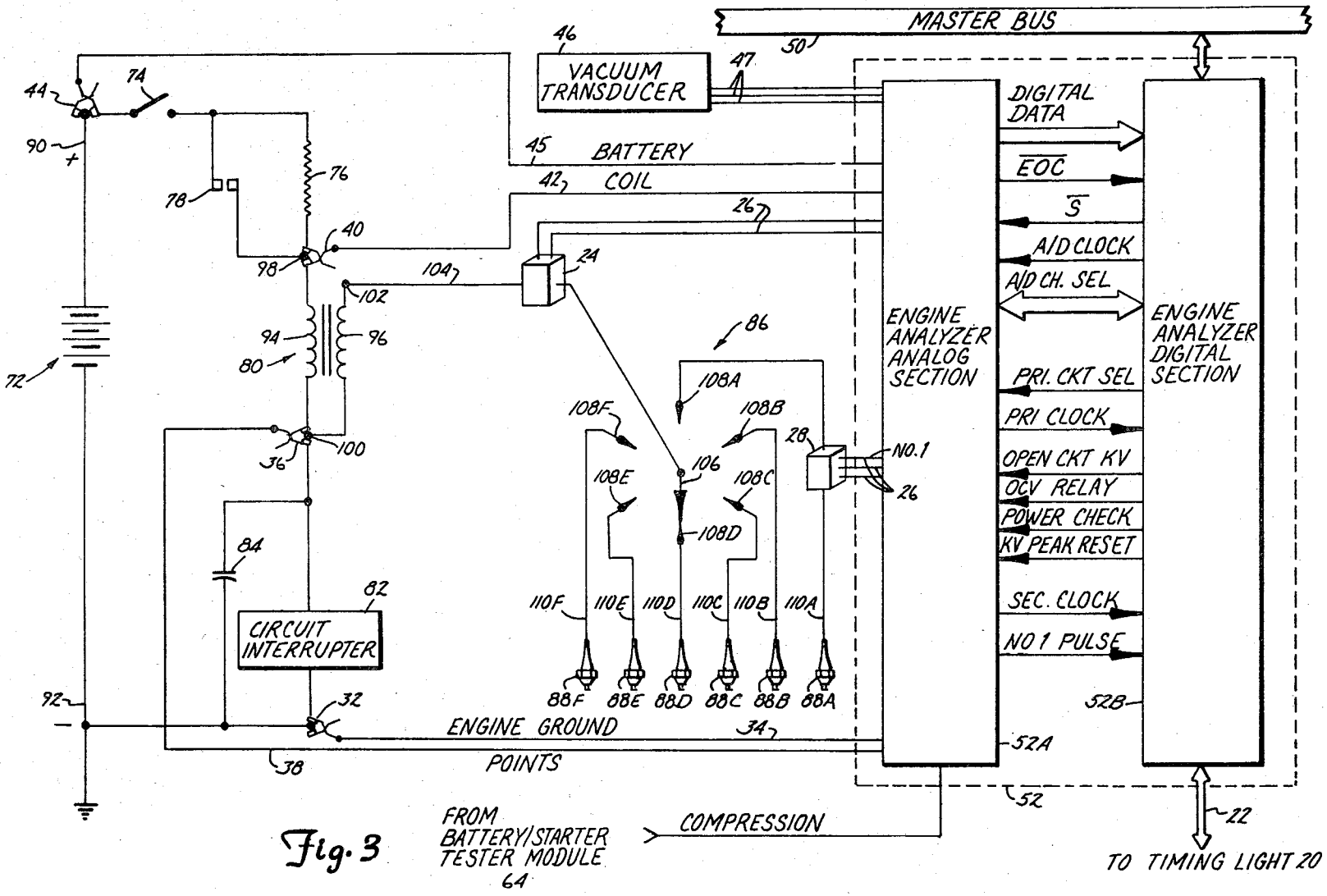
FIG. 3 shows the engine analyzer module of the apparatus of FIG. 2 in electrical schematic form in connection with a conventional ignition system of an internal combustion engine.

FIG. 3 shows engine analyzer 52 connected to a vehicle ignition system, which is schematically illustrated. The ignition system includes battery 72, ignition switch 74, ballast resistor 76, relay contacts 78, ignition coil 80, circuit interrupter 82, condensor 84, distributor 86, and igniters 88A–88F. The particular ignition system shown in FIG. 3 is for a six-cylinder internal combustion engine. Engine analyzer 10 of the present invention may be used with a wide variety of different engines having different numbers of cylinders. The six-cylinder ignition system shown in FIG. 3 is strictly for the purpose of example.

In FIG. 3, battery 72 has its positive (+) terminal 90 connected to one terminal of ignition switch 74, and its negative (−) terminal 92 connected to engine ground. Ignition switch 74 is connected in a series current path with ballast resistor 76, primary winding 94 of ignition coil 80, and circuit interrupter 82 between positive terminal 90 and engine ground (i.e. negative terminal 92). Relay contacts 78 are connected in parallel with ballast resistor 76, and are normally open during operation of the engine. Relay contacts 78 are closed during starting of the engine by a relay coil associated with the starter/cranking system (not shown) so as to short out ballast resistor 76 and thus reduce resistance in the series current path during starting of the engine.

Condensor 84 is connected in parallel with circuit interrupter 82, and is the conventional capacitor used in ignition systems. Circuit interrupter 82 is, for example, conventional breaker points operated by a cam associated with distributor 86, or is a solid state switching element in the case of solid state ignition systems now available in various automobiles.

As shown in FIG. 3, ignition coil 80 has three terminals 98, 100, and 102. Low voltage primary winding 94 is connected between terminals 98 and 100. Terminal 98 is connected to ballast resistor 76, while terminal 100 is connected to circuit interrupter 82. High voltage secondary winding 96 of ignition coil 80 is connected between terminal 100 and terminal 102. High tension wire 104 connects terminal 102 of coil 80 to distributor arm 106 of distributor 86. Distributor arm 106 is driven by the engine and sequentially makes contact with terminals 108A–108F of distributor 86. Wires 110A–110F connect terminals 108A–108F with igniters 88A–88F, respectively. Igniters 88A–88F normally take the form of conventional spark plugs. While igniters 88A–88F are shown in FIG. 3 as located in a continuous row, it will be understood that they are associated with the cylinders of the engine in such a manner as to produce the desired firing sequence. Upon rotation of distributor arm 106, voltage induced in secondary winding 96 of ignition coil 80 is successively applied to the various igniters 88A–88F in the desired firing sequence.

As shown in FIG. 3, engine analyzer 10 interfaces with the engine ignition system through engine analyzer module 52, which includes engine analyzer analog section 52A and engine analyzer digital section 52B. Input signals are derived from the ignition system by means of Engine Ground connector 32, Points connector 36, coil connector 40, Battery connector 44, HT secondary voltage probe 24, and No. 1 probe 28. In addition, a vacuum/pressure electrical input signal is produced by vacuum transducer 46, and a COMPRESSION input signal (derived from starter current) is produced by battery/starter tester module 64. These input signals are received by engine analyzer analog section 52A and are converted to digital signals which are then supplied to engine analyzer digital section 52B. Communication between engine analyzer module 52 and microprocessor 48, data memory 56, and DMA controller 58 is provided by engine analyzer digital section 52B through master bus 50. In addition, engine analyzer digital section 52B interfaces with timing light 20 through cable 22.

As illustrated in FIG. 3, Engine Ground connector 32 is connected to negative terminal 92 of battery 72, or other suitable ground on the engine. Points connector 36 is connected to terminal 100 of ignition coil 80, which in turn is connected to circuit interrupter 82. As discussed previously, circuit interrupter 82 may be conventional breaker points or a solid state switching device of a solid state ignition system. Coil connector 40 is connected to terminal 98 of coil ignition 80, and Battery connector 44 is connected to positive terminal 90 of battery 72. All four connectors 32, 36, 40 and 44 are, therefore, connected to readily accessible terminals of the ignition system, and do not require removal of conductors in order to make connections to the ignition system.

HT probe 24 is a conventional probe used to sense secondary voltage by sensing current flow through conductor 104. Similarly, No. 1 probe 28 is a conventional probe used to sense current flow through wire 110A. In the example shown in FIG. 3, igniter 88A has been designated as the igniter for the "No. 1" cylinder of the engine. Both probe 24 and probe 28 merely clamp around existing conductors, and thus do not require removal of conductors in order to make measurements.

Figure 4:
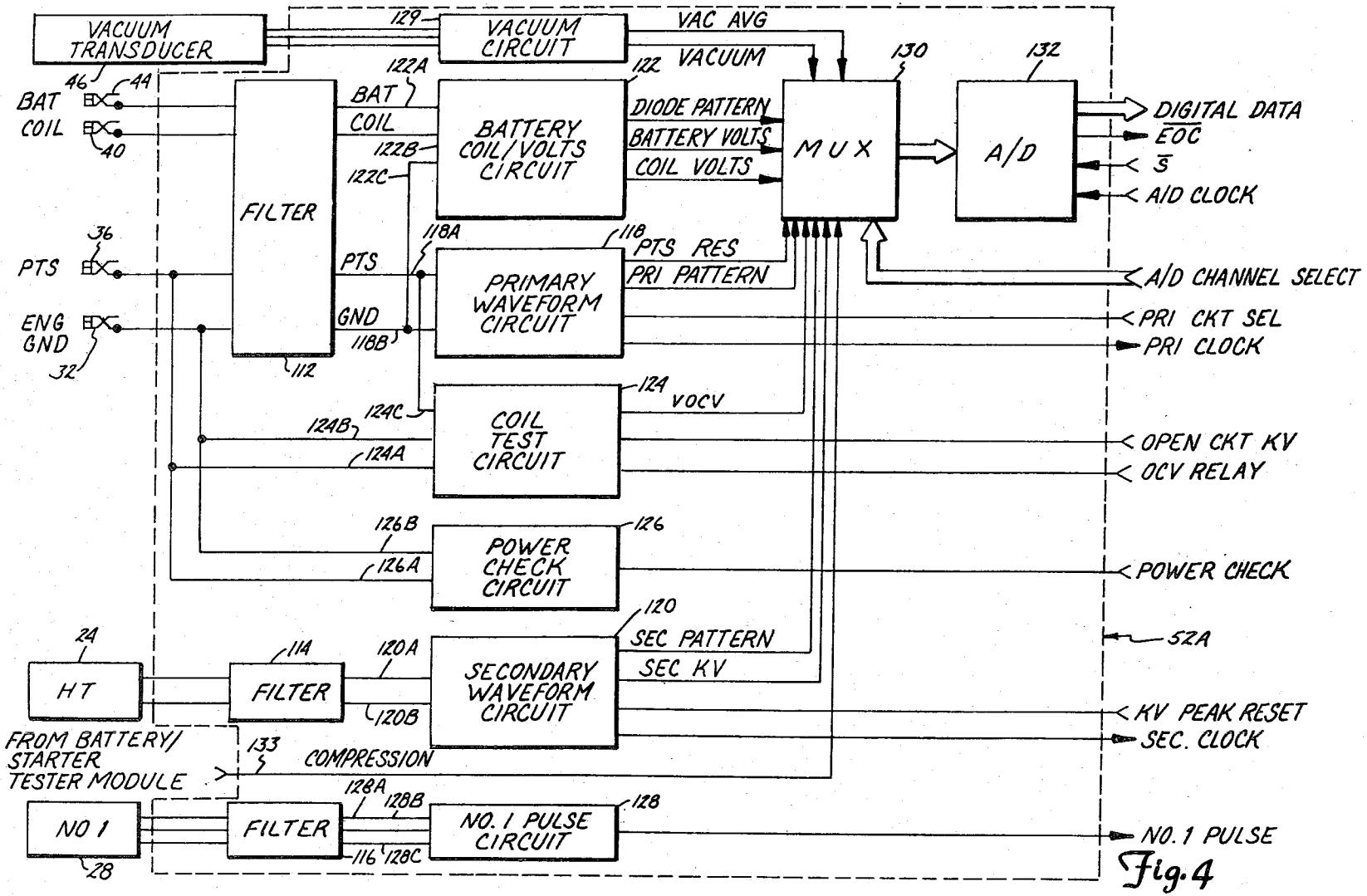
FIG. 4 is an electrical block diagram of the analog section of the engine analyzer module of FIG. 3.

FIG. 4 is an electrical block diagram showing engine analyzer analog section 52A, together with HT probe 24, No. 1 probe 28, Engine Ground connector 32, Points connector 36, Coil connector 40, Battery connector 44, and vacuum transducer 46. Analog section 52A includes input filters 112, 114, and 116, primary waveform circuit 118, secondary waveform circuit 120, battery coil/volts circuit 122, coil test circuit 124, power check circuit 126, No. 1 pulse circuit 128, vacuum circuit 129, multiplexer (MUX) 130, and analog-to-digital (A/D) converter 132. Analog section 52A supplies digital data, an end-of-conversion signal ($\overline{EOC}$), a primary clock signal (PRI CLOCK), a secondary clock signal (SEC CLOCK), and a NO. 1 PULSE signal to engine analyzer digital section 52B. Analog section 52A receives an S signal, an A/D CLOCK signal, A/D CHANNEL SELECT signals, a primary circuit select signal (PRI CKT SEL), an OPEN CKT KV signal, an OCV RELAY signal, a POWER CHECK signal and a KV PEAK RESET signal from engine analyzer digital section 52B.

Points connector 36 and engine ground connector 32 are connected through filter circuit 112 to inputs 118A and 118B, respectively, of primary waveform circuit 118. Filter circuits 112, 114 and 116 are preferably inductive-capacitive filters which filter input signals to suppress or minimize the high frequency noise signals typically generated by the ignition system. Based upon the signal appearing at its inputs, 118A and 118B, primary waveform circuit 118 supplies a primary clock signal to digital section 52B, and also provides a primary pattern (PRI PATTERN) waveform and a points resistance (PTS RES) signal to multiplexer 130.

The primary clock (PRI CLOCK) signal is a filtered signal that is 180° out of phase with the primary signal appearing between Points connector 36 and Engine Ground connector 32. The PRI CLOCK signal is a square wave signal that is high during the time period when the circuit interrupter 82 is conductive and is low during the time when circuit interrupter 82 is non-conductive. In preferred embodiments of the present invention, primary waveform circuit 118 amplifies the primary signal appearing between Points connector 36 and Engine Ground connector 32, filters the amplified signal, and compares the amplified and filtered signal to a reference or threshold voltage. This reference or threshold voltage has two levels, which are selectable by the PRI CKT SEL signal supplied by digital section 52B. The PRI CKT SEL signal causes primary waveform circuit 118 to use one threshold voltage level when conventional breaker points are used as circuit interrupter 82, and a second threshold voltage when circuit interrupter 82 is a solid state type of circuit interrupter (such as a General Motors HEI solid state ignition system).

In preferred embodiments of the present invention, primary waveform circuit 118 includes circuitry to invert the primary ignition signal in the event that the primary ignition signal is a negative going signal, which occurs with vehicles equipped with the battery positive terminal at engine ground. As a result, the PRI CLOCK signal produced by primary waveform circuit 118 is unchanged, regardless of whether the vehicle has a positive or negative ground.

Primary waveform circuit 118 also supplies the PTS RES signal to multiplexer 130. This signal is an analog voltage which is representative of the dynamic points resistance connected to Points connector 36 during the time when the circuit interrupter 82 is conductive. Primary waveform circuit 118 includes an absolute value measurement circuit which compares the signal at input 118A with ground and supplies the PTS RES signal as an analog voltage. Although the absolute value circuit within primary waveform circuit 118 does not reject the signal at input 118A during the time when circuit interrupter 82 is non-conductive, microcomputer 48 is programmed, by virtue of the executive program stored in memory 54, to restrict the acceptable values of the PTS RES signal to the time period when circuit interrupter 82 is conductive, thereby producing a valid reading of dynamic points resistance. The conductive and nonconductive times of circuit interrupter 82 are determined by microcomputer 48 from either the PRI CLOCK signal or the SEC CLOCK signal.

Primary waveform circuit 118 also produces the primary pattern (PRI PATTERN) signal. This is derived from the signal appearing at input 118A, and is supplied to multiplexer 130. Primary waveform circuit 118 includes circuitry to reduce the primary waveform appearing at points connector 36 to 1/50th of its original value by means of a voltage divider. In the preferred embodiment of the present invention, primary waveform circuit 118 determines whether the ignition signal is derived from a positive or a negative grounded system, and selectively causes inversion of the primary ignition signal, so that the PRI PATTERN signal supplied to multiplexer 130 is a positive going signal regardless of whether the vehicle has a positive or negative ground.

The secondary voltage sensed by HT probe 24 is supplied through filter 114 to inputs 120A and 120B of secondary waveform circuit 120. The secondary voltage is reduced by a capacitive divider by a factor of 10,000, is supplied through a protective circuit which provides protection against intermittent high voltage spikes, and is introduced to three separate circuits. One circuit supplies the SEC CLOCK signal; a second circuit supplies a secondary pattern (SEC PATTERN) waveform to multiplexer 130, and a third circuit supplies the SEC KV signal to multiplexer 130.

The SEC CLOCK signal is a negative going signal which occurs once for each secondary ignition signal pulse, and has a duration of approximately 1 millisecond. The inverted secondary voltage signal is amplified and is used to drive two cascaded one-shot multivibrators (not shown).

The second circuit is a voltage follower circuit which derives the SEC PATTERN waveform from the inverted secondary voltage.

The third circuit within secondary waveform circuit 120 is a peak detector circuit in which the peak voltage value of the secondary voltage is stored and supplied as the SEC KV signal. The KV PEAK RESET signal supplied by digital section 52B is used to reset the SEC KV signal to zero, so that a new measurement of the peak secondary ignition signal can be made. This process is typically repeated, with the result being a series of peak pulse secondary KV values which correspond in value to the peaks of the secondary voltage waveform.

The signal from No. 1 voltage probe 28 is supplied through inductive-capacitive type filter 116 to inputs 128A–128C of No. 1 pulse circuit 128, where it is filtered, amplified, and used to drive a pair of cascaded one-shot multivibrators (not shown). The resulting NO. 1 PULSE output signal of No. 1 pulse circuit 128 is a positive going pulse of 1 millisecond duration that corresponds in time to the ignition pulse supplied to the No. 1 igniter 88A (FIG. 3).

Battery coil/volt circuit 122 has inputs 122A, 122B and 122C which receive the BAT, COIL and GND inputs, respectively, from filter 112. Battery coil/volt circuit 112 provides three output signals (DIODE PATTERN, BATTERY VOLTS, and COIL VOLTS) to multiplexer 130.

Inputs 122A and 122C to battery coil/volt circuit 122 are AC coupled to an amplifier/filter circuit (not shown) within battery coil/volt circuit 122. The signal appearing between inputs 122A and 122C is a low level diode ripple signal, which is amplified and filtered and is supplied to multiplexer 130 as the DIODE PATTERN signal.

The voltage level at the input 122A is applied to a resistor/capacitor network (not shown), is buffered, and supplied to an absolute value circuit (not shown) to form the BATTERY VOLTS output signal of circuit 122. The BATTERY VOLTS signal is a positive voltage level output regardless of whether the vehicle under test has a positive or negative grounded battery terminal.

The signal at input 122B to battery coil/volt circuit 122 goes to a similar resistive/passive network buffer and amplifier (not shown) within circuit 122 to produce a positive voltage level output, which is labeled as the COIL VOLTS signal supplied by battery coil/volts circuit 122 to multiplexer 130.

Coil test circuit 124 measures the condition of ignition coil 80 to determine if the primary ignition circuit and coil 80 are in good condition. In the embodiment illustrated in FIG. 4, this is achieved without opening the circuit between terminal 102 of coil 80 and one of the igniters 88A–88F (shown in FIG. 3), as has been the typical practice in measuring coil condition in the past. This embodiment of coil test circuit 124 is described in further detail in the previously mentioned copending application by J. Marino, M. Kling, S. Roth, and S. Makhija, entitled "Ignition Coil Test Apparatus", which is assigned to the same assignee as the present invention. Coil test circuit 124 has terminals 124A and 124B connected to points connector 36 and engine ground connector 32, respectively, and has terminal 124C connected to the PTS output of filter 112. In addition, coil test circuit 124 receives the OPEN CKT KV and the OCV RELAY signals from digital section 52B, and provides an output circuit voltage signal ($V_{OCV}$) to multiplexer 130.

Analog section 52A also includes power check circuit 126, which has terminals 126A and 126B connected to Points connector 36 and Engine Ground connector 32, respectively. When power check circuit 126 is activated by the power check signal from digital section 52B, it effectively applies a low resistance between Points connector 36 and Engine Ground connector 32. This in effect shorts out circuit interrupter 82 and inhibits the production of a secondary ignition signal to be applied to one of the igniters 88A–88F. The power check function provided by power check circuit 126 is, therefore, generally similar to the power check function provided in other engine analyzer systems, in that selected igniters 88A–88F are disabled to determine whether the absence of that particular igniter (or igniters) significantly affects the operation of the internal combustion engine. If a particular igniter is disabled and the speed (r.p.m.) of the internal combustion engine remains relatively unchanged, this indicates that the igniter is ineffective and should be readjusted or replaced.

The electrical input signal from vacuum transducer 46 is supplied to vacuum circuit 129. The input signal is amplified to produce a VACUUM signal, which is an instantaneous waveform varying as a function of sensed vacuum or pressure. In addition, the input signal is integrated to produce a VAC AVG signal, which represents an average signal level of the input signal. Both the VACUUM signal and the VAC AVG signal are supplied to multiplexer 130.

A COMPRESSION signal is supplied on line 133 to multiplexer 130. The COMPRESSION signal is an analog waveform signal derived from starter current, processed by battery/starter tester module 64, and then delivered to analog section 52A on line 133.

As shown in FIG. 4, multiplexer 130 receives the PTS RES and PRI PATTERN signals from primary waveform circuit 118, the SEC PATTERN and SEC KV signals from secondary waveform circuit 120, the DIODE PATTERN, BATTERY VOLTS and COIL VOLTS signals from battery coil/volt circuit 122, the $V_{OCV}$ signal from coil test circuit 124, the VACUUM and VAC AVG signals from vacuum circuit 129, and the COMPRESSION signal from line 133. Each of these signals is an analog signal, which is selectively supplied by multiplexer 130 to A/D converter 132. The particular analog signal supplied to A/D converter 132 is determined by the A/D CHANNEL SELECT signals supplied to multiplexer 130 by digital section 52B. In a preferred embodiment, the A/D CHANNEL SELECT signals are supplied on four digital control lines, thus giving a total of sixteen different channels which can be selected. Based upon the particular channel selected, multiplexer 130 supplies one of the analog input signals to A/D converter 132 for conversion.

A/D converter 132 is a high speed analog-to-digital converter which is enabled by the S signal from digital section 52B and provides data conversions at a rate determined by the A/D CLOCK signal supplied from digital section 52B.

A/D converter 132 samples the input signal at the rate determined by A/D CLOCK signal and supplies digital data to digital section 52B. In a preferred embodiment, if a waveform is to be digitized A/D converter 132 samples the input signal five hundred twelve times. This produces a total of five hundred twelve digitized points on a waveform, which permits an accurate reconstruction of the waveform on raster scan display 14.

Figure 5:
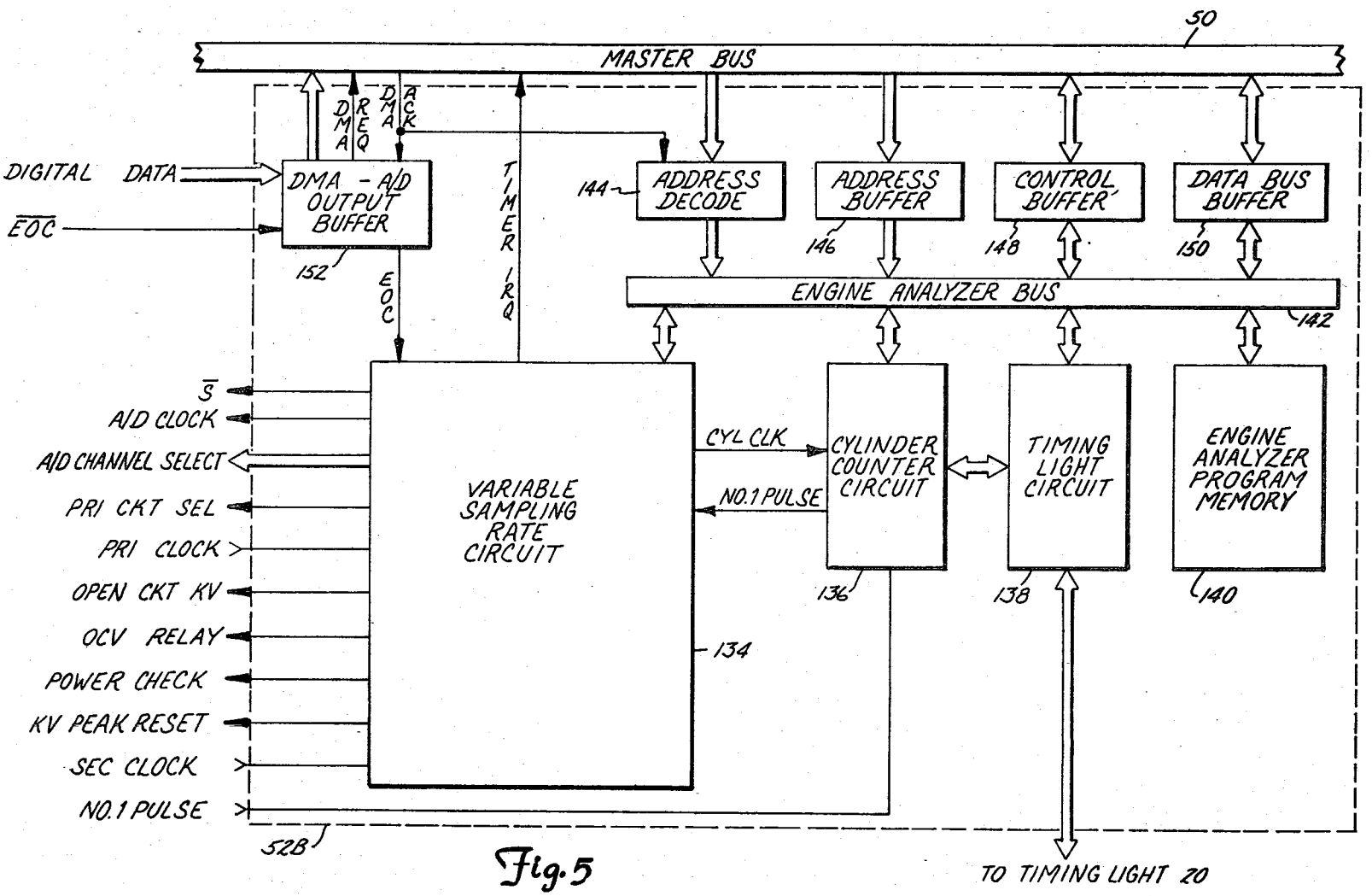
FIG. 5 is an electrical block diagram of the digital section of the engine analyzer module of FIG. 3.

FIG. 5 is an electrical block diagram of digital section 52B of engine analyzer module 52. Digital section 52B includes variable sampling rate circuit 134, cylinder counter circuit 136, timing light circuit 138 and engine analyzer program memory 140, all of which are connected to engine analyzer bus 142. In preferred embodiments of the present invention, engine analyzer bus 142 includes digital data lines, address lines and control lines. Interface betweeen digital section 52B and the remaining circuitry of engine analyzer 10 is provided by means of master bus 50. Address decode circuit 144, address buffer circuit 146, control buffer circuit 148, data bus buffer circuit 150, and DMA-A/D output buffer circuit 152 provide an interface between master bus 50 and the remaining circuitry of digital section 52B.

Variable sampling rate circuit 134 receives the PRI CLOCK and SEC CLOCK signals from analog section 52A, and provides the various control signals to analog section 52A which determine the particular test being performed and the particular digital data which is received from analog section 52A. These control signals include the $\overline{S}$ and A/D CLOCK signals supplied to A/D converter 132, the A/D CHANNEL SELECT signal supplied to multiplexer 130, the PRI CKT SEL signal supplied to primary waveform circuit 118, the OPEN CKT KV and OCV RELAY signals supplied to coil test circuit 124, the POWER CHECK signal supplied to power check circuit 126 and the KV PEAK RESET signal supplied to secondary waveform circuit 120. Variable sampling rate circuit 134 produces the CYL CLK signal, which is based upon either the PRI CLOCK or the SEC CLOCK signal and supplies this signal to cylinder counter circuit 136. The CYL CLK signal is also used by variable sampling rate circuit 134 to determine the period of the primary or secondary waveform. Variable sampling rate circuit 134 supplies this period measurement to microprocessor 48 via engine analyzer bus 142 and master bus 150. Based upon this period measurement, microprocessor 48 selects the desired data sample rate to be used by A/D converter 132, and supplies control signals to variable sampling rate circuit 134 via master bus 150 and engine analyzer bus 142. The data sample rate is controlled by variable sampling rate circuit 134 by means of the A/D CLOCK signal. Variable sampling rate circuit 134 also receives the $\overline{EOC}$ signal from DMA-A/D output buffer 152 and the NO. 1 PULSE signal from cylinder counter circuit 136.

In many of the test functions performed by engine analyzer module 52, it is necessary to determine the current cylinder number at various points in time. These engine tests include waveform displays, power check test and timing measurements. Keeping track of cylinder number by using microprocessor 48 becomes inconvenient, particularly when microprocessor 48 is involved in digitizing waveforms, and in reconstructing waveforms for display on raster scan display 14. In the preferred embodiment shown in FIG. 5, cylinder counter circuit 136 performs this cylinder number function. Cylinder counter circuit 136 includes a presettable counter which is loaded with the number of cylinders of the engine under test by data supplied from microprocessor 48 through master bus 50, data bus 150 and engine analyzer bus 142. The number of cylinders of the engine under test is typically supplied to microprocessor 48 through user interface 16.

Cylinder counter circuit 136 counts in response to the CYL CLK signal. The current count of cylinder counter circuit 136 is provided both to the engine analyzer bus 142 and to timing light circuit 138.

The NO. 1 PULSE signal from analog section 52A is supplied to cylinder counter circuit 136. At the beginning of operation of engine analyzer module 52, the first pulse of the NO. 1 PULSE signal presets cylinder counter circuit 136 and thereby synchronizes it to the engine. After that, the No. 1 probe 28 can be removed and the NO. 1 PULSE signal discontinued, and cylinder counter circuit 136 will still remain in synchronization with the engine as long as the CYL CLK signal continues to be supplied. Cylinder counter circuit 136 also is capable of operation without the NO. 1 PULSE signal, and in that case is synchronized to the engine operation by manual inputs supplied by the operator either through use interface 16 or control switches on timing light 20. In this case, the synchronization pulse is supplied through engine analyzer bus 142 to cylinder counter circuit 136, rather than from the NO. 1 PULSE signal.

Timing light circuit 138 controls operation of timing light 20, based upon control signals from microcomputer 48, the cylinder count from cylinder counter circuit 136, and operator input signals supplied from control switches on timing light 20.

In the preferred embodiment shown in FIG. 5, the operation of engine analyzer module 52, under the control of microprocessor 48, is based upon a stored engine analyzer program stored in engine analyzer program memory 140. When the operator selects, through user interface 16, a test function involving engine analyzer module 52, microprocessor 48 interrogates engine analyzer module 52 to determine that it is present in the system, and addresses engine analyzer program memory 140 for the operating instructions required for that particular test. In preferred embodiments of the present invention, each test module such as engine analyzer module 52, exhaust analyzer module 62, and battery/-starter tester module 64 (FIG. 2) has its own associated program memory. As a result, only that memory capacity required for the particular test modules being used is provided.

As discussed previously, transfer of digital data from A/D converter 132 to data memory 56 is provided by DMA controller 58. Digital data from A/D converter 132 is supplied to DMA-A/D output buffer 52. When A/D converter 132 supplies an $\overline{EOC}$ signal to output buffer 152, a DMA request (DMA REQ) signal is supplied by output buffer 52 to master bus 50. DMA converter 58 then takes control of master bus 50 and supplies a DMA acknowledge (DMA ACK) signal to output buffer 152. The digital data from A/D converter 132 is then supplied by output buffer 52 onto master bus 50. DMA controller 58 supplies the addresses to put the individual bytes of data into proper memory locations within data memory 56. DMA controller 58 has the initial address of the first byte of data to be stored (which depends upon the particular test being performed) and the number of bytes of data to be stored. As each byte of data is transferred from output buffer 152 to data memory 56, DMA controller 58 changes the address, and keeps track of the number of bytes which have been stored. When the predetermined number of bytes of data have been transferred, DMA controller 58 relinquishes control of master bus 50 to microprocessor 48, and the data transfer to data memory 56 ceases, even if A/D converter 132 is continuing to sample and convert the particular input signal from multiplexer 130 to digital data.

The present invention provides a constant width waveform display on raster display 14 regardless of the speed (RPM) of the engine under test. In the case of an ignition waveform, such as a primary or secondary waveform signal for a single cylinder of the engine, the period P of that waveform changes with the engine RPM. This creates a problem in displaying a full width waveform based upon digitized data from A/D converter 132, since the number of data samples N and the data sample rate R are related to the period P of the waveform by the following relationship:

$$P=N/R \qquad \text{Equation 1}$$

As engine RPM changes, either N or R (or both) must be changed to ensure that no more or less than one waveform period is stored.

Changing the number of data samples N has several disadvantages. First, memory space in data memory 56 is inefficiently utilized, since adequate memory space must be provided for the largest period possible. When higher engine speeds are encountered, the period P of the waveform will be shorter, and only a portion of the memory space will be used. Since memory is relatively expensive, the inefficient use of memory space is undesirable.

Second, timing is greatly complicated by changing the number of data samples N. Raster scan display 14 normally displays a fixed number of points, and changing to a variable number of points greatly complicates the control of operation of raster scan display 14.

In the present invention, therefore, the number of data samples N is maintained constant, while the data sample rate of A/D converter 132 is varied by variable sampling rate circuit 134 to accommodate changes in the engine RPM. Variable sampling rate circuit 134, under the control of microprocessor 48, varies data sample rate R as a function of period P so as to maintain the number of data samples N constant (in the preferred embodiment N=512). This embodiment of the present invention has several important advantages. First, since N is constant, memory space within data memory 56 is used efficiently. Second, system timing is simplified, particularly with respect to operation of raster scan display 14.

Figure 6:
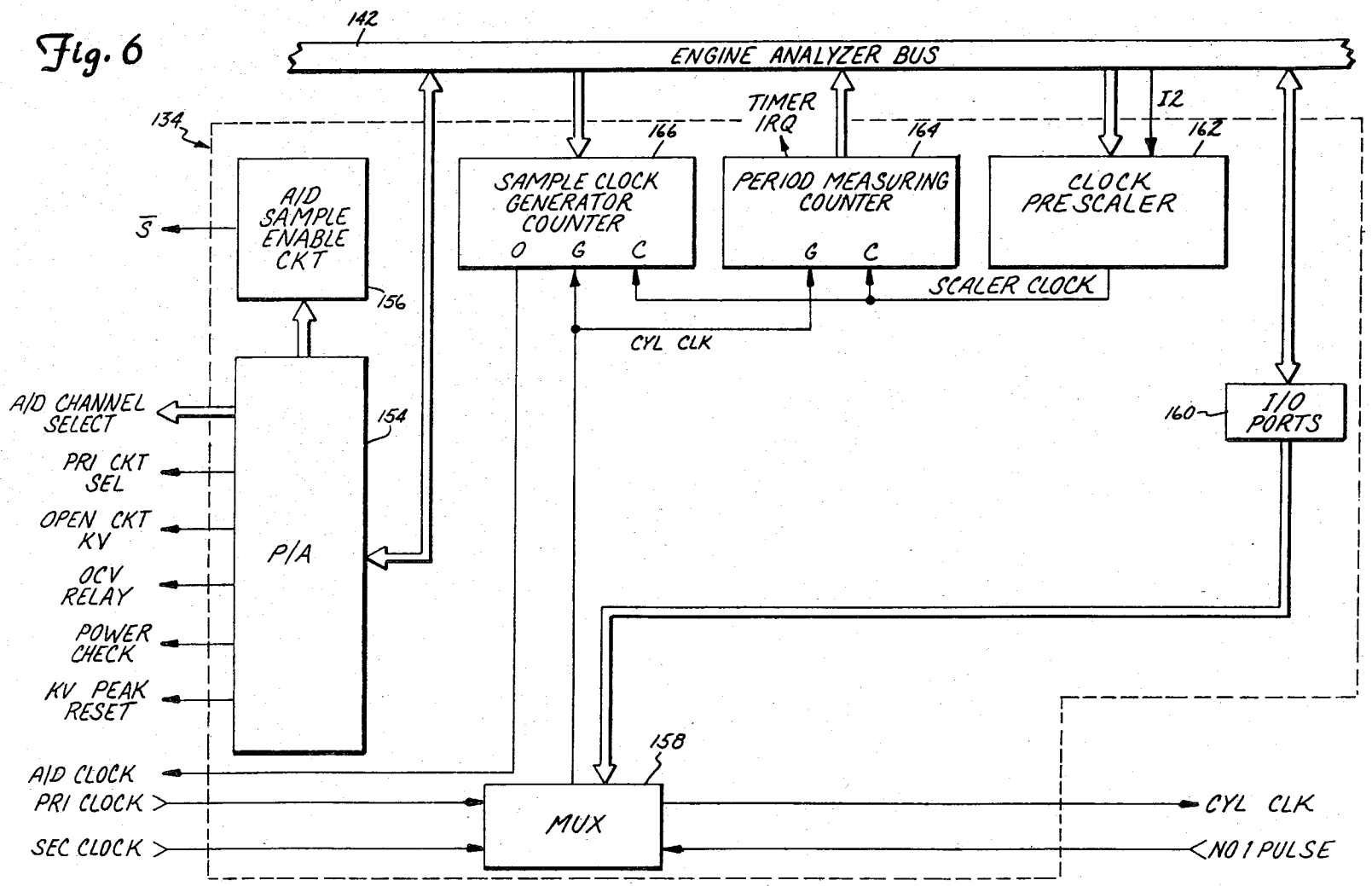
FIG. 6 is an electrical block diagram of a variable sample rate circuit of the digital section shown in FIG. 5.

FIG. 6 is a block diagram showing variable sampling rate circuit 134 and engine analyzer bus 142. Variable sampling rate circuit 134 includes programmable interface adapter (PIA) 154, A/D sample enable circuit 156, multiplexer 158, input/output (I/O) ports 160, clock prescaler 162, period measuring counter 164, and sample rate generator counter 166.

PIA 154 is controlled by microprocessor 48 (FIG. 2) via engine analyzer bus 142. Through PIA 154 and A/D enable circuit 156 (which is controlled by PIA 154), microprocessor 48 produces the S, A/D CHANNEL SELECT, PRI CKT SELECT, OPEN CKT KV, OCV RELAY, POWER CHECK and KV PEAK RESET signals.

Multiplexer 158 receives the PRI CLK and SEC CLK signals from analog section 52A and the NO. 1 PULSE signal from cylinder counter circuit 136. Multiplexer 158 supplies one of these signals to the gates of sample clock generator counter 166 and period measuring counter 164 based upon an input signal supplied by I/O ports 160 under the control of microprocessor 48. When either the PRI CLK signal or the SEC CLK signal is supplied, this signal is the CYL CLK signal, which is also supplied to cylinder counter circuit 136.

Clock prescaler 162 receives data from engine analyzer bus 142 which selects a frequency for its SCALER CLOCK output signal. Clock prescaler 162 also receives a clock signal Ø2 from engine analyzer bus 142, which is preferably on the order of 1 MHz. Microprocessor 48 selects, by the scaling factor supplied to clock prescaler 162, either the 1 MHz frequency of the Ø2 signal or some lower frequency for the SCALER CLOCK signal frequency.

The SCALER CLOCK signal is supplied to the clock (C) input of period measuring counter 164. The period of the input waveform, which is represented by the CYL CLK signal supplied to the gate (G) input of period measuring counter 164, is measured by counting the SCALER CLOCK pulses while the period measuring counter 164 is gated on by the CYL CLK signal. When the measurement of period has been completed, period measuring counter 164 generates a TIMER IRQ interrupt signal which is supplied to microprocessor 48 via master bus 50. The measured period is then transferred from period measuring counter 164 to microcomputer 48 via engine analyzer bus 142, data bus buffer 150, and master bus 50. If period measuring counter 164 has overflowed, or if the count is so small that the desired number of samples N will not be produced using that particular SCALER CLOCK frequency, microprocessor 48 adjusts the scaling factor used by clock prescaler 162, and a new measurement is taken. Clock prescaler 162, therefore, is effectively a range selection device which provides a lower SCALER CLOCK frequency for use at low engine RPM and a higher SCALER CLOCK frequency for use at higher engine RPM.

The measured period value from period measuring counter 164 is actually a count of SCALER CLOCK cycles that occur during one period of the input waveform to be digitized. Microprocessor 48 divides this value by N (the number of data points to be stored per period) and then loads the quotient Q into sample clock generator counter 166. The SCALER CLOCK signal from clock prescaler 162 is supplied to the clock (C) input of sample clock generator 166, and the CYL CLK signal is supplied to the gate (G) input of sample clock generator counter 166. The output (O) of sample clock generator counter 166 is the A/D CLOCK signal which determines the sample rate R of A/D converter 132. Sample clock generator counter 166 produces a A/D CLOCK pulse at its output every Q counts after having been enabled by the CYL CLK signal. Therefore N samples are taken in one waveform period.

The resulting data sample rate R produced by sample clock generator counter 166 is inversely proportional to the input waveform period P, and therefore the number of samples N remains constant despite changes in engine RPM. In the embodiment shown in FIG. 6, period measuring counter 164 produces a period count K according to the following relationship:

$$K=PC \qquad \text{Equation 2}$$

where C=SCALER CLOCK rate

The quotient Q computed by microprocessor 48 and supplied to sample clock generator counter 166 is given by the following relationship:

$$Q=K/N=PC/N \qquad \text{Equation 3}$$

Sample clock generator counter 166 produces an A/D CLOCK sample pulse every Q cycles of the SCALER CLOCK signal. Therefore:

$$R=C/Q=C/PC/N=N/P \qquad \text{Equation 4}$$

Equation 4 corresponds to Equation 1 above. The system of FIG. 6, therefore generates the A/D CLOCK signal at a rate R which will produce the desired number N of data samples to achieve a constant width waveform on raster scan display 14 despite changes in the period of the input waveform to be digitized.

The operation of engine analyzer 10 in digitizing and displaying a constant width simulated waveform can be further understood by the following example. In this example, it will be assumed that a primary waveform for the No. 1 cylinder is to be digitized and displayed. It should be understood, however, that the same process is performed for any of the various cylinders, and for other waveforms such as the secondary waveforms.

When the operator selects a primary waveform for the No. 1 cylinder, microprocessor 48 first measures the period of the waveform of the No. 1 cylinder by means of clock prescaler 162 and period measuring counter 164. Microprocessor 48 selects the PRI CLOCK signal to be supplied through multiplexer 158 to the gate (G) input of period measuring counter 164. Cylinder counter circuit 136 indicates when the No. 1 cylinder waveform is present.

Once microprocessor 48 has performed the period measurement routine and has set the clock prescaler 162 and sample clock generator counter 166 with proper values, it also sets up PIA 154 so that when cylinder counter circuit 136 reaches the proper cylinder, A/D sample enable circuit 156 will provide the $\overline{S}$ signal which enables A/D converter 132 to begin conversion.

Microprocessor 48 also sets up DMA controller 58 (FIG. 2) so that the waveform being digitized will be stored in the right location within data memory 56 (FIG. 2). In particular, microprocessor 48 sets up two registers (not shown) within DMA controller 58. One register is an address register which gives DMA controller 58 the address in data memory 56 for the first byte of digital data of the waveform. The second register is a count register which is set to five hundred twelve so that DMA controller 58 will transfer five hundred twelve bytes to data memory 56.

Once a setting up of sample rate and of DMA controller 58 has been completed, microprocessor 48 goes on to other tasks, and leaves the A/D conversion process alone. When the proper cylinder is attained by cylinder counter circuit 136, A/D sample enable circuit 156 supplies the $\overline{S}$ signal which starts A/D converter 132. At the end of each conversion, A/D converter 132 sends an EOC signal back through DMA-A/D output buffer 152 to DMA controller 58, which takes the results of the conversion and stores it in data memory 56. This process occurs in an interleaved fashion with the other operations of microprocessor 48. DMA controller 58 operates in a "cycle stealing mode" in which it steals some clock cycles from microprocessor 48 during which it takes control of master bus 50 and transfers data directly from engine analyzer module 52 to data memory 56. While this process is occurring, microprocessor 48 is performing other functions, particularly drawing a waveform which was digitized for a previous cylinder. This cycle stealing mode allows the entire operation to be faster, since microprocessor 48 does not get involved in the digitizing process, and can be performing other functions while the A/D conversion and storage process is being performed.

In a preferred embodiment of the present invention, multiplexer 158, which is controlled by microprocessor 48 through I/O ports 160, provides further flexibility in the operation of variable sampling rate circuit 134. For example, multiplexer 158 preferably includes circuitry for inverting the PRI CLK and SEC CLK signals under control of microprocessor 48, so that sample clock generator counter 166 can be gated on by either the POINTS OPEN signal transition or the POINTS CLOSE signal transition of the CYL CLK signal.

In addition, microcomputer 48 can measure the period of a full engine cycle by controlling multiplexer 158 to supply the NO. 1 PULSE signal to the gate input of period measuring counter 164. In this mode, microprocessor 48 uses period measuring counter 164 to provide a count which represents the RPM of the engine.

In the preferred embodiment of the present invention, the operator can "expand" or "contract" the portion of the waveform being displayed by input signals supplied through user interface 16. The operator can request, therefore, that the beginning of the waveform be expanded, and microprocessor 48 achieves this by decreasing the quotient Q supplied to sample clock generator counter 166. This in effect increases the rate R of A/D CLOCK signal, and thus causes the predetermined number of data samples N to be completed before the end of the period of the waveform. The resolution of the portion of the waveform stored and later displayed is thus increased, since the frequency of the A/D CLOCK signal is increased.

In conclusion, the engine analyzer of the present invention samples analog waveforms associated with operation of an internal combustion engine and produces a constant width waveform regardless of engine RPM. This is achieved by determining the period P of the waveform to be stored, and then varying the sample rate R at which the A/D converter 132 samples the analog waveform and converts the sample waveform to digital data. As a result, the number of data samples N, and thus the width of the displayed waveform, is constant.

The engine analyzer of the present invention provides great flexibility both as to the particular waveforms which are digitized and later displayed, and in the manner in which the waveforms are subsequently displayed on raster scan display 14. Because the waveforms displayed on raster scan display 14 are reconstructed waveforms based upon previously stored digital data in data memory 56, a wide variety of waveform display formats are possible with the engine analyzer of the present invention. In some cases, similar display formats are not possible with real time displays.

Although the present invention has been described with reference to preferred embodiments, workers skilled in the art will recognize that changes may be made in form and detail without departing from the spirit and scope of the invention.

What is claimed is:

1. A test system for testing operation of a selected system or component of an internal combustion engine, the test system comprising:

means for providing a periodic analog input waveform representative of operation of the system or component of the internal combustion engine under a test condition, the periodic analog input waveform having a period which varies as a function of engine speed;

analog-to-digital (A/D) converter means for sampling the analog input waveform periodically at a data sample rate and converting each sample to a digital value;

means for controlling the data sample rate of the analog-to-digital converter means as a function of the period of the input waveform to produce a predetermined number of digital values representative of the input waveform;

data memory means for storing the predetermined number of digital values; and display means for displaying a simulated visual representation of the input waveform based upon the stored predetermined number of digital values, the simulated visual representation being representative of operation of the system and component of the internal combustion engine under the test condition.

2. The test system of claim 1 wherein the means for controlling the data sample rate comprises:

sample clock generator means for supplying an A/D clock signal to the A/D converter means having a first frequency which determines the data sample rate of the A/D converter means;

period measuring means for measuring the period of the input waveform; and means for providing a frequency control signal to the sample clock generator means as a function of the measured period to cause the data sample rate to be inversely proportional to the measured period.

3. The test system of claim 2 wherein the period measuring means comprises:

means for providing a scaler clock signal with a second frequency; and a period measuring counter means for counting in response to the scaler clock signal during the period of the input waveform to produce a digital count which is indicative of the period.

4. The test system of claim 3 wherein the frequency control signal is a digital frequency control value, and wherein the sample clock generator means comprises a sample clock generator counter which counts in response to the scaler clock signal and produces the A/D clock signal with the first frequency which is equal to the second frequency divided by a digital frequency control value.

5. The test system of claim 4 wherein the means for providing a scaler clock signal comprises:

clock prescaler means for receiving a clock signal of a third frequency and for providing the scaler clock signal with the second frequency being a function of the third frequency and a digital prescaling value.

6. The test system of claim 5 and further comprising:

programmed digital computer means for providing the digital prescaling value to the clock prescaler means and providing the digital frequency control value to the sample clock generator counter based upon the digital count of the period measuring counter.

7. A test system for testing operation of a selected system or component of an internal combustion engine, the test system comprising:

means for providing an analog input waveform representative of operation of the selected system or component of the internal combustion engine under a test condition, the analog input waveform having a period which varies as a function of engine speed;

analog-to-digital (A/D) converter means for sampling the analog input waveform periodically at a date sample rate and converting each sample to a digital value;

data memory means for storing the digital values;

display means for displaying a simulated visual representation of the input waveform based upon the stored digital value, the simulated visual representation being representative of operation of the selected system or component of the internal combustion engine under the test condition;

sample clock generator means for supplying an A/D clock signal to the A/D converter means which determines the data sample rate of the A/D converter means;

means for supplying a signal to the A/D converter means to initiate sampling of the analog input waveform by the A/D converter means; and means for transferring a predetermined number of digital values representative of the input waveform from the A/D converter means to selected locations in the data memory means.

8. The test system of claim 7 and further comprising:

period measuring means for measuring the period of the input waveform; and means for providing a frequency control signal to the sample clock generator means as a function of the measured period.

9. The test system of claim 8 wherein the period measuring means measures the period of the input waveform during a cycle of the internal combustion engine preceding a cycle of the internal combustion engine during which the A/D converter means samples the input waveform.

10. The test system of claim 8 wherein the means for providing a frequency control signal is a programmed digital computer means.

11. The test system of claim 10 wherein the digital computer means provides the means for transferring a digital signal indicative of an address of the data memory means for storing the digital values and a digital signal indicative of the predetermined number of digital values to be transferred.

12. The test system of claim 11 wherein the means for transferring comprises a direct memory access (DMA) controller.

13. The test system of claim 12 wherein the A/D converter means provides an end-of-conversion signal upon completion of converting each sample to a digital value, and wherein the DMA controller transfers the digital value to a selected memory location in the data memory means until the predetermined number of digital values have been transferred.

14. The test system of claim 7 and further comprising:

user interface means for requesting a selected input waveform to be displayed;

multiplexer means for receiving a plurality of analog input waveforms representative of operation of various systems or components of the internal combustion engine; and means for providing an A/D channel select signal to the multiplexer means to cause the multiplexer means to provide the selected analog input waveform to the A/D converter means.

15. The test system of claim 14 wherein the internal combustion engine includes an electrical ignition system, the test system further comprising:

primary waveform circuit means for deriving from the ignition system a primary analog input waveform for each cylinder of the engine; and secondary waveform circuit means for deriving from the ignition system a secondary analog input waveform for each cylinder of the engine.

16. The test system of claim 15 wherein the means for supplying a signal to the A/D converter means to initiate sampling comprises:

cylinder counter means for counting in response to a signal derived from the ignition system of the internal combustion engine to provide an indication of when a selected analog input waveform for a selected cylinder will be generated; and means for supplying the signal to the A/D converter means to initiate sampling of the analog input waveform when the cylinder counter means indicates that the selected analog input waveform will be generated.

17. A test system for testing operation of a selected system or component of an internal combustion engine, the test system comprising:

means for providing a periodic analog input waveform representative of operation of the selected system or component of the internal combustion engine under a test condition, the periodic analog input waveform having a period which varies as a function of engine speed;

analog-to-digital (A/D) converter means for sampling the analog input waveform periodically at a data sample rate in response to an A/D clock signal and converting each sample to a digital value;

period measuring means for measuring the period of the input waveform prior to sampling of the input waveform;

sample clock generator means for supplying the A/D clock signal to the A/D converter means as a function of the measured period;

data memory means for storing a predetermined number of digital values from the A/D converter means; and display means for displaying a simulated visual representative of the input waveform based upon the stored predetermined number of digital values, the simulated visual representation being representative of operation of the selected system or component of the internal combustion engine under the test condition.

18. The test system of claim 17 wherein the period measuring means comprises:

means for providing a scaler clock signal with a known frequency; and period measuring counter means for counting in response to the scaler clock signal during the period of the input waveform to produce a digital count which is indicative of the period.

19. The test system of claim 18 wherein the frequency control signal is a digital frequency control value, and wherein the sample clock generator means comprises a sample clock generator counter which counts in response to the scaler clock signal and produces the A/D clock signal with a frequency which is equal to the frequency of the scaler clock signal divided by a digital frequency control value.

20. A test system for testing operation of a selected system or component of an internal combustion engine, the test system comprising:

means for providing an analog input waveform representative of operation of the selected system or component of the internal combustion engine under a test condition, the analog input waveform being a period which varies as a function of engine speed;

analog-to-digital (A/D) converter means for sampling the analog input waveform periodically at a data sample rate in response to an A/D clock signal and converting each sample to a digital value;

data memory means for storing the digital values from the A/D converter means;

display means for displaying a simulated visual representation of the input waveform based upon the stored digital values, the simulated visual representation being representative of operation of the selected system or component of the internal combustion engine under the test condition;

period measuring means for measuring the period of the input waveform prior to sampling of the input waveform by the A/D converter means;

means for supplying the A/D clock signal to the A/D converter means as a function of the measured period;

means for supplying a signal to the A/D converter means to initiate sampling of the analog input waveform by the A/D converter means; and means for transferring a predetermined number of digital values representative of the input waveform from the A/D converter means to selected locations in the data memory means.

21. The test system of claim 20 wherein the means for supplying the A/D clock signal causes the A/D clock signal to have a frequency such that the data sample rate is inversely proportional to the measured period.

* * * * *

UNITED STATES PATENT AND TRADEMARK OFFICE

CERTIFICATE OF CORRECTION

PATENT NO. : B1 4,399,407

DATED : February 7, 1995

INVENTOR(S) : Michael J. Kling, et. al.

It is certified that error appears in the above-indentified patent and that said Letters Patent is hereby corrected as shown below:

Column 1, line 59, delete "is", insert --it--

Signed and Sealed this

Thirtieth Day of May, 1995

*Attest:*

*Attesting Officer*

BRUCE LEHMAN

*Commissioner of Patents and Trademarks*

US004399407B1

REEXAMINATION CERTIFICATE (2466th)

United States Patent [19]

Kling et al.

[11] B1 4,399,407

[45] Certificate Issued Feb. 7, 1995

[54] ENGINE ANALYZER WITH CONSTANT WIDTH DIGITAL WAVEFORM DISPLAY

[75] Inventors: Michael J. Kling, Mequon; Joseph A. Marino, Waukesha, both of Wis.

[73] Assignee: Bear Automotive Service Equipment Co., Milwaukee, Wis.

Reexamination Request:
No. 90/003,244, Nov. 5, 1993

Reexamination Certificate for:

| | |
|---|---|
| Patent No.: | **4,399,407** |
| Issued: | **Aug. 16, 1983** |
| Appl. No.: | **327,511** |
| Filed: | **Dec. 4, 1981** |

[51] Int. Cl.[6] ..... F02P 17/00
[52] U.S. Cl. ..... 324/379; 73/117.3; 324/384; 364/431.04
[58] Field of Search ..... 324/166; 364/431.03, 364/431.04

[56] References Cited

U.S. PATENT DOCUMENTS

| | | | |
|---|---|---|---|
| 3,816,815 | 6/1974 | Schumann | 324/112 |
| 4,068,310 | 1/1978 | Friauf | 364/521 |
| 4,072,851 | 2/1978 | Rose | 364/487 |
| 4,125,894 | 11/1978 | Cashel et al. | 364/442 |
| 4,283,713 | 8/1981 | Philipp | 340/347 |
| 4,418,388 | 11/1983 | Allgor et al. | 364/431.01 |

FOREIGN PATENT DOCUMENTS 1541379 2/1979 United Kingdom .

OTHER PUBLICATIONS

Allen Service Manual for SMART SCOPE, bearing 1980 copyright date.
Letter dated Dec. 8, 1992 from Michigan Auto Test Inc. regarding public use of the Allen SMARTSCOPE in Feb., 1980.
Allen sales brochure for SMART SCOPE, bearing No. J80-0003, allegedly meaning Sep., 1980 (J represents the ninth month, because the I was not used).
Allen brochure for SMART SCOPE, bearing code number J80-0002, again allegedly meaning Sep., 1980.
Allen price sheet for SMART SCOPE and other products, No. 980SU, bearing the date Sep. 19, 1980.
Michigan Auto Test quote to Gilmore Cadillac-Pontiac-Datsun, dated Oct. 20, 1980.

*Primary Examiner*—Gerard R. Strecker

[57] ABSTRACT

An engine analyzer for an internal combustion engine includes an analog-to-digital (A/D) converter which digitizes an analog electrical input waveform representing, for example, a secondary or primary voltage waveform of the ignition coil of the internal combustion engine. The digitized input waveform is stored in the form of digital data in data memory. Upon request by the operator of the apparatus, a microprocessor selects digital data stored, and supplies that digital data to a display, which displays a visual representation of the waveform based upon the selected digital data. The engine analyzer apparatus produces a constant width waveform regardless of engine RPM, by determining the period of the waveform to be stored, and then varying the sample rate at which the A/D converter samples the analog waveform and converts the sampled waveform to digital data. As a result, the number of data samples, and thus the width of the displayed waveform, is constant.

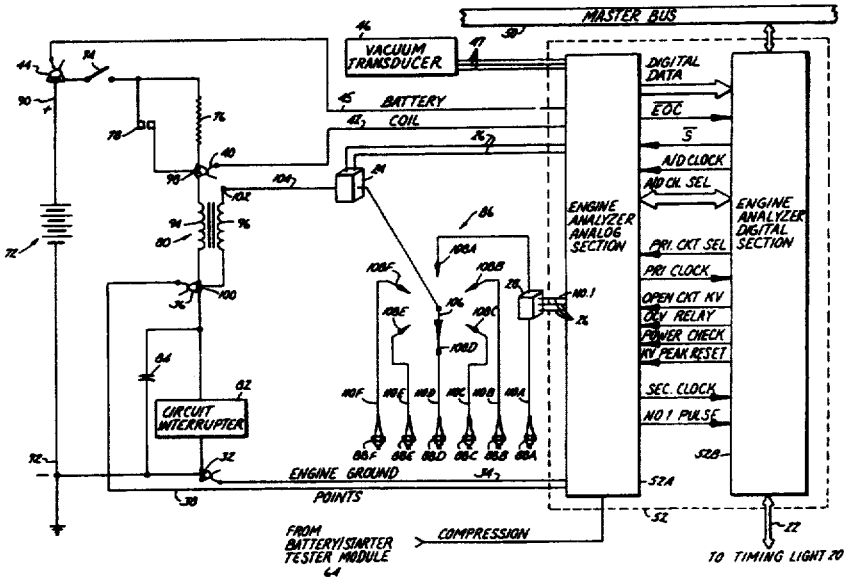

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 7, 17 and 20 are determined to be patentable as amended.

Claims 2–6, 8–16, 18, 19 and 21, dependent on an amended claim, are determined to be patentable.

New claims 22–37 are added and determined to be patentable.

1. A test system for testing operation of a selected system or component of an internal combustion engine, the test system comprising:

means for providing a periodic analog input waveform representative of operation of the system or component of the internal combustion engine under a test condition, the periodic analog input waveform having a period which varies as a function of engine speed;

analog-to-digital (A/D) converter means for sampling the analog input waveform periodically at a data sample rate and converting each sample to a digital value;

means for controlling the data sample rate of the analog-to-digital converter means as a function of the period of the input waveform to produce a predetermined number of digital values representative of the input waveform;

data memory means for storing the predetermined number of digital values; [and]

*point addressable* display means for displaying a *reconstructed* simulated *analog* visual representation of the input waveform based upon *digital display data which is a function of* the stored predetermined number of digital values, the *reconstructed* simulated [visual representation being] *waveform having an appearance of a continuous analog waveform* representative of operation of the system and component of the internal combustion engine under the test condition*; and*

*means for generating the digital display data representing pixels on the point addressable display means which produce the reconstructed simulated waveform so that is has the appearance of a continuous analog waveform, the digital display data including data corresponding to pixels representing individual sampled points of the waveform defined by the predetermined number of digital values and data corresponding to intermediate pixels between the individual sampled points of the waveform.*

7. A test system for testing operation of a selected system or component of an internal combustion engine, the test system comprising:

means for providing an analog input waveform representative of operation of the selected system or component of the internal combustion engine under a test condition, the analog input waveform having a period which varies as a function of engine speed;

analog-to-digital (A/D) converter means for sampling the analog input waveform periodically at a [date] *data* sample rate and converting each sample to a digital value;

data memory means for storing the digital values;

*point addressable* display means for displaying a *reconstructed* simulated [visual representation of the input] *analog* waveform based upon *digital display data which is a function of* the stored digital [value] *values*, the simulated [visual representation being] *reconstructed waveform having an appearance of a continuous analog waveform* representative of operation of the selected system or component of the internal combustion engine under the test condition;

sample clock generator means for supplying an A/D clock signal to the A/D converter means which determines the data sample rate of the A/D converter means;

means for supplying a signal to the A/D converter means to initiate sampling of the analog input waveform by the A/D converter means; [and]

means for transferring a predetermined number of digital values representative of *individual sampled points of* the input waveform from the A/D converter means to selected locations in the data memory means*; and*

*means for generating the digital display data representing pixels on the point addressable display means which produce the reconstructed simulated waveform so that it has the appearance of a continuous analog waveform, the digital display data including data corresponding to pixels representing individual sampled points of the waveform defined by the predetermined number of digital values and data corresponding to intermediate pixels between the individual sampled points of the waveform.*

17. A test system for testing operation of a selected system or component of an internal combustion engine, the test system comprising:

means for providing a periodic analog input waveform representative of operation of the selected system or component of the internal combustion engine under a test condition, the periodic analog input waveform having a period which varies as a function of engine speed;

analog-to-digital (A/D) converter means for sampling the analog input waveform periodically at a data sample rate in response to an A/D clock signal and converting each sample to a digital value;

period measuring means for measuring the period of the input waveform prior to sampling of the input waveform;

sample clock generator means for supplying the A/D clock signal to the A/D converter means as a function of the measured period;

data memory means for storing a predetermined number of digital values from the A/D converter means; [and]

*point addressable* display means for displaying a *reconstructed* simulated [visual representative of the input] *analog* waveform based upon *digital display*

*data which is a function of* the stored predetermined number of digital values, the *reconstructed* simulated [visual representation being] *waveform having an appearance of a continuous analog waveform* representative of operation of the selected system or component of the internal combustion engine under the test condition; *and*

*means for generating the digital display data representing pixels on the point addressable display means which produce the reconstructed simulated waveform so that it has the appearance of a continuous analog waveform, the digital display including data corresponding to pixels representing individual sampled points of the waveform defined by the predetermined number of digital values and data corresponding to intermediate pixels between the individual sampled points of the waveform.*

20. A test system for testing operation of a selected system or component of an internal combustion engine, the test system comprising:

means for providing an analog input waveform representative of operation of the selected system or component of the internal combustion engine under a test condition, the analog input waveform being a period which varies as a function of engine speed;

analog-to-digital (A/D) converter means for sampling the analog input waveform periodically at a data sample rate in response to an A/D clock signal and converting each sample to a digital value;

data memory means for storing the digital values from the A/D converter means;

*point addressable* display means for displaying a *reconstructed* simulated [visual representation of the input] *analog* waveform based upon *digital display data which is a function of* the stored digital values, the *reconstructed* simulated [visual representation being] *waveform having an appearance of a continuous analog waveform* representative of operation of the selected system or component of the internal combustion engine under the test condition;

period measuring means for measuring the period of the input waveform prior to sampling of the input waveform by the A/D converter means;

means for supplying the A/D clock signal to the A/D converter means as a function of the measured period;

means for supplying a signal to the A/D converter means to initiate sampling of the analog input waveform by the A/D converter means; [and]

means for transferring a predetermined number of digital values representative of the input waveform from the A/D converter means to selected locations in the data memory means; *and*

*means for generating the digital display data representing pixels on the point addressable display means which produce the reconstructed simulated waveform so that it has the appearance of a continuous analog waveform, the digital display including data corresponding to pixels representing individual sampled points of the waveform defined by the predetermined number of digital values and data corresponding to intermediate pixels between the individual sampled points of the waveform.*

*22. The test system of claim 7 and further comprising:*

*means for selecting a test to be performed and for entering into the test system information relating to a number of cylinders in the internal combustion engine and a cylinder firing order; and*

*means for identifying the individual cylinders to which the digital values pertain based upon the cylinder firing order and a signal derived from the engine.*

*23. The test system of claim 7 and further comprising:*

*a peak detector connected to the means for providing an analog input waveform.*

*24. The test system of claim 7 wherein the analog input waveform includes individual cylinder firing periods and wherein the test system further comprises:*

*means for generating a digital control word which is representative of engine speed and is based upon a signal derived from the engine;*

*wherein the sample clock generator means generates the A/D sample clock signal as a function of the digital control word; and*

*wherein the A/D converter means samples the analog input waveform periodically in response to the A/D sample clock signal such that the A/D converter means generates the predetermined number of digital values per cylinder firing period.*

*25. The test system of claim 24 wherein the predetermined number of digital values is approximately 512.*

*26. The test system of claim 24 and further comprising:*

*means for selecting a test to be performed and for entering into the test system information relating to a number of cylinders in the internal combustion engine and a cylinder firing order;*

*means for maintaining a cylinder count based upon the cylinder firing order and a signal derived from the engine; and*

*wherein the means for transferring transfers the predetermined number of digital values from the A/D converter means to the data memory means and wherein the predetermined number of digital values correspond to a selected cylinder based on the cylinder count and the test selected.*

*27. The test system of claim 24 wherein:*

*the sample clock generator means has counter means for receiving the digital control word and for providing a sample clock pulse within the A/D sample clock signal once every Q counts of the counter means, wherein Q is an integer based on the digital control word such that the A/D converter means provides the predetermined number of digital values for each cylinder firing period.*

*28. The test system of claim 24 and further comprising:*

*means for modifying the digital control word to increase the data sample rate of the A/D converter means to thereby expand the simulated analog visual representation.*

*29. The test system of claim 7 wherein:*

*the analog input waveform includes individual cylinder firing periods; and*

*the predetermined number of digital values transferred to the data memory means are selected such that the digital values represent a selected individual cylinder firing period within the analog input waveform at temporal positions in the analog input waveform which are a function of engine speed.*

*30. The test system of claim 7 and further comprising:*

*means for supplying a scaler clock signal;*

*means for determining a quotient Q as a function of engine speed; and*

*wherein the sample clock generator means further includes a sample clock counter which supplies the A/D clock signal once every Q counts.*

*31. A test system for testing operation of a selected system or component of an internal combustion engine having a number of cylinders and a cylinder firing order, the test system comprising:*

*means for providing periodic analog input waveforms, including primary and secondary ignition waveforms for each cylinder of the engine, the periodic analog input waveforms being representative of operation of the selected system or component of the internal combustion engine under a test condition and having periods corresponding to individual cylinder firings which vary as a function of engine speed;*

*means for selecting a test to be performed and for entering into the test system information relating to the number of cylinders in the internal combustion engine and the cylinder firing order;*

*means for providing a multiplexer select signal as a function of the test selected;*

*multiplexer means for receiving the periodic analog input waveforms and the multiplexer select signal and for providing a selected analog input waveform as a function of the multiplexer select signal;*

*a peak detector connected to the means for providing periodic analog input waveforms and to the multiplexer means;*

*means for generating a digital control word which is representative of engine speed and is based upon at least one of the periodic analog input waveforms;*

*sample clock generator means for supplying an A/D sample clock signal as a function of the digital control word;*

*analog-to-digital (A/D) converter means for receiving the selected analog input waveform and the A/D sample clock signal, for sampling the selected analog input waveform periodically in response to the A/D sample clock signal at a data sample rate, and for converting each sample to a digital value, the A/D converter means providing a predetermined number of digital values for each cylinder firing period;*

*data memory means for storing the digital values;*

*means for maintaining a cylinder count based upon a signal derived from the engine;*

*means for supplying a signal to the A/D converter means to initiate sampling of the analog input waveform by the A/D converter means;*

*means for transferring the predetermined number of digital values from the A/D converter means to selected locations in the data memory means, wherein the predetermined number of digital values are selected as a function of the cylinder count and the test selected;*

*point addressable display means for displaying a reconstructed simulated analog visual representation of the input waveform based upon digital display data which is a function of the stored predetermined number of digital values, the reconstructed simulated waveform having an appearance of a continuous analog waveform representative of operation of the system and component of the internal combustion engine under the test condition; and*

*means for modifying the digital control word to increase the data sample rate of the A/D converter means to thereby expand the simulated analog visual representation; and*

*means for generating the digital display data representing pixels on the point addressable display means which produce the reconstructed simulated waveform so that is has the appearance of a continuous analog waveform, the digital display data including data corresponding to pixels representing individual sampled points of the waveform defined by the predetermined number of digital values and data corresponding to intermediate pixels between the individual sampled points of the waveform.*

*32. The test of claim 31 wherein the predetermined number of digital values is approximately 512.*

*33. A test system for testing operation of a selected system or component of an internal combustion engine having a number of cylinders and a cylinder firing order, the test system comprising:*

*means for providing periodic analog input waveforms, including primary and secondary ignition waveforms for each cylinder of the engine, the periodic analog input waveforms being representative of operation of the selected system or component of the internal combustion engine under a test condition and having periods corresponding to individual cylinder firings which vary as a function of engine speed;*

*means for selecting a test to be performed and for entering into the test system information relating to the number of cylinders in the internal combustion engine and the cylinder firing order;*

*means for providing a multiplexer select signal as a function of the test selected;*

*multiplexer means for receiving the periodic analog input waveforms and the multiplexer select signal and for providing a selected analog input waveform as a function of the multiplexer select signal;*

*a peak detector connected to the means for providing periodic analog input waveforms;*

*analog-to-digital (A/D) converter means for receiving the selected analog input waveform, for sampling the selected analog input waveform periodically at a data sample rate, and for converting each sample to a digital value, the A/D converter means providing a predetermined number of digital values for each cylinder firing period;*

*means for generating a digital control word which is representative of engine speed and is based upon at least one of the periodic analog input waveforms;*

*sample clock generator means for supplying an A/D sample clock signal to the A/D converter means as a function of the digital control word, which determines the data sample rate of the A/D converter means, the sample clock generator means having counter means for receiving the digital control word and providing a sample clock pulse within the A/D sample clock signal once every Q counts of the counter means, wherein Q is an integer based on the digital control word such that the A/D converter means provides the predetermined number of digital values for each cylinder firing period;*

*data memory means for storing the digital values;*

*means for maintaining a cylinder count based upon a signal derived from the engine;*

*means for supplying a signal to the A/D converter means to initiate sampling of the analog input waveform by the A/D converter means;*

*means for transferring the predetermined number of the digital values from the A/D converter means to selected locations in the data memory means;*

*point addressable display means for displaying a reconstructed simulated analog visual representation of the input waveform based upon digital display data which is a function of the stored predetermined number of digital values, the reconstructed simulated waveform*

*having an appearance of a continuous analog waveform representative of operation of the system and component of the internal combustion engine under the test condition; and*

*means for generating the digital display data representing pixels on the point addressable display means which produce the reconstructed simulated waveform so that is has the appearance of a continuous analog waveform, the digital display data including data corresponding to pixels representing individual sampled points of the waveform defined by the predetermined number of digital values and data corresponding to intermediate pixels between the individual sampled points of the waveform.*

*34. The test system of claim 33 wherein the predetermined number of digital values is approximately 512.*

*35. The test system of claim 33 and further comprising:*

*means for modifying the digital control word to increase the data sample rate of the A/D converter means to thereby expand the simulated analog visual representation.*

*36. A test system for testing operation of a selected system or component of an internal combustion engine having a number of cylinders and a cylinder firing order, the test system comprising:*

*means for providing periodic analog input waveforms, including primary and secondary ignition waveforms for each cylinder of the engine, the periodic analog input waveforms being representative of operation of the selected system or component of the internal combustion engine under a test condition and having periods corresponding to individual cylinder firings which vary as a function of engine speed;*

*means for selecting a test to be performed;*

*means for entering into the test system information relating to the number of cylinders in the internal combustion engine and the cylinder firing order;*

*means for providing a multiplexer select signal as a function of the test selected;*

*multiplexer means for receiving the periodic analog input waveforms and the multiplexer select signal and for providing a selected analog input waveform as a function of the multiplexer select signal;*

*analog-to-digital (A/D) converter means for receiving the selected analog input waveform, for sampling the selected analog input waveform periodically at a data sample rate, and for converting each sample to a digital value;*

*sample clock generator means for supplying an A/D sample clock signal to the A/D converter means which determines the data sample rate of the A/D converter means;*

*data memory means for storing the digital values;*

*means for identifying the individual cylinders to which the digital values pertain based upon the cylinder firing order and at least one of the periodic analog input waveforms;*

*means for supplying a signal to the A/D converter means to initiate sampling of the analog input waveform by the A/D converter means;*

*means for supplying a scaler clock signal;*

*means for determining a quotient Q as a function of engine speed;*

*means for transferring a predetermined number of the digital values representative of the selected analog input waveform based upon the quotient from the A/D converter means to selected locations in the data memory means;*

*point addressable display means for displaying a reconstructed simulated analog visual representation of the input waveform based upon digital display data which is a function of the stored predetermined number of digital values, the reconstructed simulated waveform having an appearance of a continuous analog waveform representative of operation of the system and component of the internal combustion engine under the test condition;*

*means for generating the digital display data representing pixels on the point addressable display means which produce the reconstructed simulated waveform so that is has the appearance of a continuous analog waveform, the digital display data including data corresponding to pixels representing individual sampled points of the waveform defined by the predetermined number of digital values and data corresponding to intermediate pixels between the individual sampled points of the waveform; and*

*wherein the sample clock generator means further includes a sample clock counter which supplies the A/D clock signal once every Q counts.*

*37. The test system of claim 7 and further comprising:*

*a display memory means for storing the digital display data.*

* * * * *

US004399407B2

REEXAMINATION CERTIFICATE (3716th)

United States Patent [19] [11] B2 4,399,407

Kling et al. [45] Certificate Issued Feb. 9, 1999

[54] ENGINE ANALYZER WITH CONSTANT WIDTH DIGITAL WAVEFORM DISPLAY

[75] Inventors: Michael J. Kling, Mequon; Joseph A. Marino, Waukesha, both of Wis.

[73] Assignee: SPX Corporation, Muskegon, Mich.

Reexamination Requests:
No. 90/004,031, Nov. 13, 1995
No. 90/004,588, Mar. 21, 1997

Reexamination Certificate for:
Patent No.: 4,399,407
Issued: Aug. 16, 1983
Appl. No.: 327,511
Filed: Dec. 4, 1981

Reexamination Certificate B1 4,399,407 issued Feb. 7, 1995

Certificate of Correction issued May 30, 1995.

[51] Int. Cl.[6] ..... F02P 17/00
[52] U.S. Cl. ..... 324/379; 73/117.3; 324/384; 701/102
[58] Field of Search ..... 324/379, 378, 324/384; 73/117.3, 117.2, 116; 364/551, 431.03, 442

[56] References Cited

U.S. PATENT DOCUMENTS

| | | | |
|---|---|---|---|
| 3,686,662 | 8/1972 | Blixt et al. | 340/324 A |
| 3,909,671 | 9/1975 | Nakaya . | |
| 3,982,193 | 9/1976 | Maringer | 328/151 |
| 4,050,296 | 9/1977 | Benedict | 73/116 |
| 4,053,831 | 10/1977 | Furukawa et al. | 324/77 A |
| 4,125,894 | 11/1978 | Cashel et al. | 364/442 |
| 4,128,005 | 12/1978 | Arnston et al. | 73/117.3 |
| 4,208,723 | 6/1980 | Lecklider | 364/900 |
| 4,418,388 | 11/1983 | Allgor et al. | 364/431.01 |

OTHER PUBLICATIONS

Brochure entitled "AVL Digital Analyzer" (May 1978) (Exhibit A).
Instruction manual for AVL Digital Analyzer Type 646 (04 LD/LA/211/E) (Sep., 1979) (Exhibit C).
Function Description and Trouble Shooting Instructions for AVL Type 646 Digital Analyzer (Oct., 1979) (Exhibit H).
Article entitled "Electronic Measuring System for Digital Recording and Analysing of High Speed Processes" Krassnig (Iseta 75, fourth International Symposium on Engine Testing Automation Performance, Emission & Diagnostics (Sep. 29–Oct. 3, 1975) (Exhibit I).
Instruction Manual Software F CIS V03 C/E for AVL Digital Analyzer System 646 (May, 1979) (Exhibit J).

*Primary Examiner*—Gerard R. Strecker

[57] ABSTRACT

An engine analyzer for an internal combustion engine includes an analog-to-digital (A/D) converter which digitizes an analog electrical input waveform representing, for example, a secondary or primary voltage waveform of the ignition coil of theinternal combustion engine. The digitized input waveform is stored in the form of digital data in a data mamory. Upon request by the operator of the apparatus, a microprocessor selects digital data stored, and supplies that digital data to a display, which displays a visual representation of the waveform based upon the selected digital data. The engine analyzer apparatus produces a constant width waveform regardless of engine RPM, by determining the period of the waveform to be stored, and then varying the sample rate at which the A/D converter smaples the analog waveform and converts the sampled waveform to digital data. As a result, the number of data samples, and thus the width of the displayed waveform, is constant.

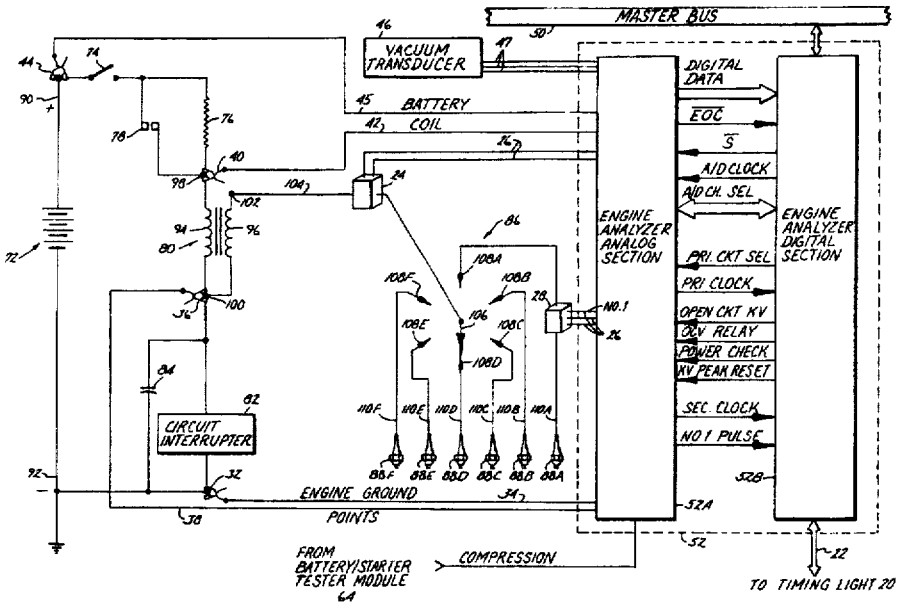

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–19 and 22–37 is confirmed.

Claims 1 and 20 are determined to be patentable as amended.

Claims 2–6 and 21, dependent on an amended claim, are determined to be patentable.

New claims 38–41 are added and determined to be patentable.

1. A test system for testing operation of a selected system or component of an internal combustion engine, the test system comprising:

means for providing a periodic analog input waveform representative of operation of the system or component of the internal combustion engine under a test condition, the periodic analog input waveform having a period which varies as a function of engine speed;

analog-do-digital (A/D) converter means for sampling the analog input waveform periodically at a data sample rate and converting each sample to a digital value;

means for controlling the data sample rate of the analog-to-digital converter means as a function of the period of the input waveform to produce a predetermined number of digital values representative of the input waveform;

data memory means for storing the predetermined number of digital values;

point addressable display means for displaying a reconstructed simulated analog visual representative of the input waveform based upon digital display data which is a function of the stored predetermined number of digital values, the reconstructed simulated waveform having an appearance of a continuous analog waveform representative of operation of the system and the component of the internal combustion engine under the test condition; and means for generating the digital display data representing pixels on the point addressable display means which produce the reconstructed simulated waveform so that [is] *it* has the appearance of a continuous analog waveform, the digital display data including data corresponding to pixels representing individual sampled points of the waveform defined by the predetermined number of digital values and data corresponding to intermediate pixels between the individual sampled points of the waveform.

20. A test system for testing operation of a selected system or component of an internal combustion engine, the test system comprising:

means for providing an analog input waveform from an electrical ignition system of the internal combustion engine representative of operation of the selected system or component under a test condition, the analog input waveform [being] *having* a period which varies as a function of engine speed;

analog-to-digital (A/D) converter means for sampling the analog input waveform periodically at a data sample rate in response to an A/D clock signal and converting each sample to a digital value;

data memory means for storing the digital values from the A/D converter means;

point addressable display means for displaying a reconstructed simulated analog waveform based upon digital display data which is a function of the stored digital values, the reconstructed simulated waveform having an appearance of a continuous analog waveform representative of operation of the selected system of component of the internal combustion engine uner the test condition;

period measuring means for measuring the period of the input waveform prior to sampling of the input waveform by the A/D converter means;

means for supplying the A/D clock signal to the A/D converter means as a function of the measured period;

means for supplying a signal to the A/D converter means to initiate sampling of the analog input waveform by the A/D converter means;

means for transferring a predetermined number of digital values representative of the input waveform from the A/D converter means to selected locations in the data memory means; and means for generating the digital display data representing pixels on the point addressable display means which produce the reconstructed simulated waveform so that it has the appearance of a continuous analog waveform, the digital display including data corresponding to pixels representing individual sampled points of the waveform defined by the predetermined number of digital values and data corresponding to intermediate pixels between the individual sampled points of the waveform.

*38. A test system for testing operation of a selected system or component of an internal combustion engine, the test system comprising:*

*means for providing a periodic analog input waveform from an electrical ignition system of the internal combustion engine representative of operation of the selected system or component under a test condition, the periodic analog input waveform having a period which varies as a function of engine speed;*

*analog-to-digital (A/D) converter means for sampling the analog input waveform periodically at a data sample rate and converting each sample to a digital value;*

*means for controlling the data sample rate of the analog-to-digital converter means as a function of the period of the input waveform to produce a predetermined number of digital values representative of the input waveform;*

*data memory means for storing the predetermined number of digital values;*

*point addressable display means for displaying a reconstructed simulated analog visual representation of the input waveform based upon digital display data which is a function of the stored predetermined number of digital values, the reconstructed simulated waveform having an appearance of a continuous analog wave-*

*form representative of operation of the system and component of the internal combustion engine under the test condition; and*

*means for generating the digital display data representating pixels on the point addressable display means which produce the reconstructed simulated waveform so that it has the appearance of a continuous analog waveform, the digital display data including data corresponding to pixels representing individual sampled points of the waveform defined by the predetermined number of digital values and data corresponding to intermediate pixels between the individual sampled points of the waveform.*

*39. A test system for testing operation of a selected system or component of an internal combustion engine, the test system comprising:*

*means for providing an analog input waveform from an electrical ignition system of the internal combustion engine representative of operation of the selected system or component under a test condition, the analog input waveform having a period which varies as a function of engine speed;*

*analog to digital (A/D) converter means for sampling the analog input waveform periodically at a data sample rate and converting each sample to a digital value;*

*data memory means for storing the digital values;*

*point addressable display means for displaying a reconstructed simulated analog waveform based upon digital display data which is a function of the stored digital values, the simulated reconstructed waveform having an appearance of a continuous analog waveform representative of operation of the selected system or component of the internal combustion engine under the test condition;*

*sample clock generator means for supplying an A/D clock signal to the A/D converter means which determines the data sample rate of the A/D converter means;*

*means for supplying a signal to the A/D converter means to initiate sampling of the analog input waveform by the A/D converter means;*

*means for transferring a predetermined number of digital values representative of individual sampled points of the input waveform from the A/D converter means to selected locations in the data memory means; and*

*means for generating the digital display data representating pixels on the point addressable display means which produce the reconstructed simulated waveform so that it has the appearance of a continuous analog waveform, the digital display data including data corresponding to pixels representing individual sampled points of the waveform defined by the predetermined number of digital values and data corresponding to intermediate pixels between the individual sampled points of the waveform.*

*40. A test system for testing operation of a selected system or component of an internal combustion engine, the test system comprising:*

*means for providing a periodic analog input waveform from an electrical ignition system of the internal combustion engine representative of operation of the selected system or component under a test condition, the periodic analog input waveform having a period which varies as a function of engine speed;*

*analog-to-digital (A/D) converter means for sampling the analog input waveform periodically at a data sample rate in response to an A/D clock signal and converting each sample to a digital value;*

*period measuring means for measuring the period of the input waveform prior to sampling of the input waveform;*

*sample clock generator means for supplying the A/D clock signal to the A/D converter means as a function of the measured period;*

*data memory means for storing a predetermined number of digital values from the A/D converter means;*

*point addressable display means for displaying a reconstructed simulated analog waveform based upon digital display data which is a function of the stored predetermined number of digital values, the reconstructed simulated waveform having an appearance of a continuous analog waveform representative of operation of the selected system or component of the internal combustion engine under the test condition; and*

*means for generating the digital display data representing pixels on the point addressable display means which produce the reconstructed simulated waveform so that it has the appearance of a continuous analog waveform, the digital display including data corresponding to pixels representing individual sampled points of the waveform defined by the predetermined number of digital values and data corresponding to intermediate pixels between the invididual sampled points of the waveform.*

*41. A test system for testing operation of a selected system or component of an internal combustion engine, the test system comprising:*

*means for providing an analog input waveform from an electrical ignition system of the internal combustion engine representative of operation of the selected system or component under a test condition, the analog input waveform having a period which varies as a function of engine speed;*

*analog-to-digital (A/D) converter means for sampling the analog input waveform periodically at a data sample rate in response to an A/D clock signal and converting each sample to a digital value;*

*data memory means for storing the digital values from the A/D converter means;*

*point addressable display means for displaying a reconstructed simulated analog waveform based upon digital display which is a function of the stored digital values, the reconstructed simulated waveform having an appearance of a continuous analog waveform representative of operation of the selected system or component of the internal combustion engine under the test condition;*

*period measuring means for measuring the period of the input waveform prior to sampling of the input waveform by the A/D converter means;*

*means for supplying the A/D clock signal to the A/D converter means as a function of the measured period;*

*means for supplying a signal to the A/D converter means to initiate sampling of the analog input waveform by the A/D converter means;*

*means for transferring a predetermined number of digital values representative of the input waveform from the A/D converter means to selected locations in the data memory means; and*

*means for generating the digital display data representing pixels on the point addressable display means which*

*produce the reconstructed simulated waveform so that it has the appearance of a continuous analog waveform, the digital display including data corresponding to pixels representing individual sampled points of the waveform defined by the predetermined number of digital values and data corresponding to intermediate pixels between the individual sampled points of the waveform.*

* * * * *